US006913508B2

(12) United States Patent
Hornsby et al.

(10) Patent No.: US 6,913,508 B2
(45) Date of Patent: Jul. 5, 2005

(54) RACE CAR AND TRACK

(76) Inventors: James R. Hornsby, No. 2 Ballantrae Dr., St. Louis, MO (US) 63131; Kurt V. Ulmer, 4901 McPherson Ave., St. Louis, MO (US) 63108; Joseph L. McGowan, 1533 Heritage Manor Cir., St. Charles, MO (US) 63303; Marcellus R. Benson, 15058 Manor Creek Dr., St. Louis, MO (US) 63017

( * ) Notice: Subject to any disclaimer, the term of this patent is extended or adjusted under 35 U.S.C. 154(b) by 156 days.

(21) Appl. No.: 09/942,156

(22) Filed: Aug. 29, 2001

(65) Prior Publication Data

US 2002/0072294 A1 Jun. 13, 2002

Related U.S. Application Data

(60) Provisional application No. 60/229,654, filed on Aug. 31, 2000.

(51) Int. Cl.[7] ..... A63H 18/06
(52) U.S. Cl. ..... 446/438; 446/444
(58) Field of Search ..... 446/429, 431, 446/435, 438, 444, 445, 457, 459, 462, 464

(56) References Cited

U.S. PATENT DOCUMENTS

| | | | | | |
|---|---|---|---|---|---|
| 4,106,695 | A | | 8/1978 | Carella et al. | |
| 4,193,223 | A | * | 3/1980 | D'Andrade et al. | 446/438 |
| 4,195,776 | A | | 4/1980 | Lehmann | |
| 4,394,961 | A | * | 7/1983 | Muller | 238/10 R |
| 4,519,789 | A | * | 5/1985 | Halford et al. | 446/444 |
| 4,813,905 | A | * | 3/1989 | Yamaguchi et al. | 446/438 |
| 4,940,443 | A | | 7/1990 | Hesse | |
| 4,997,187 | A | | 3/1991 | Smollar et al. | |
| 5,846,117 | A | * | 12/1998 | McGaffigan | 446/219 |
| 6,171,171 | B1 | * | 1/2001 | Barthold | 446/438 |
| 6,241,573 | B1 | * | 6/2001 | Ostendorff et al. | 446/444 |
| 6,358,112 | B1 | * | 3/2002 | Lambert et al. | 446/429 |

* cited by examiner

*Primary Examiner*—Jacob K. Ackun, Jr.
(74) *Attorney, Agent, or Firm*—Richard B. Klar, Esq.

(57) ABSTRACT

A toy race car and track system are disclosed having illuminated portions in the car and the track that are illuminated by light sources based on movement of the car on the track. The car includes a pull-back motor and has translucent windows for display of the light source inside the car. The track is a modular track system having interchangeable track portions and other parts. The track system includes a jump and a gauge for measuring the height of a vehicle on the jump. The gauge illuminates when the car travels through it and includes a break-away sign at the end of the gauge that detaches when the car reaches the end. The track system also includes a jump and loop portion, in which the jump launches the car upside down toward one of a plurality of loops that catch the car and redirect it back toward the jump. The car then is launched from the jump to an inner loop to decreased jump speed, and the process repeats until the car no longer has sufficient speed to reach the loops. The track system also includes a criss-cross loop for use with two cars at the same time, operated by start gates. The cars travel on separate tracks toward the loop, at which point they are directed toward each other on a single track, at which point they either crash or proceed into a funnel portion that determines a winner of the race.

9 Claims, 41 Drawing Sheets

206
205
210
209
203

206
207
208
202
205
200
201
204
203

100

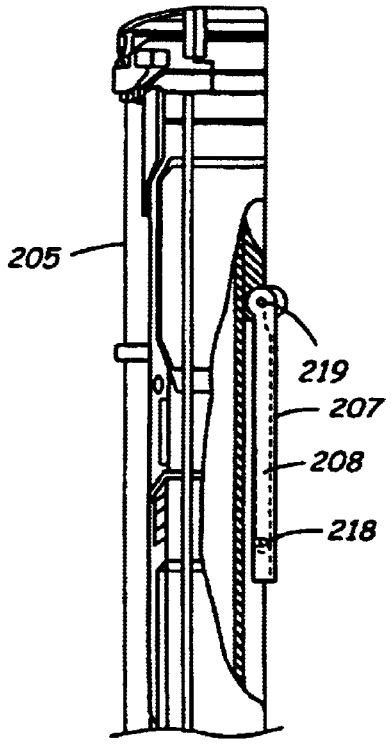
FIG. 13A
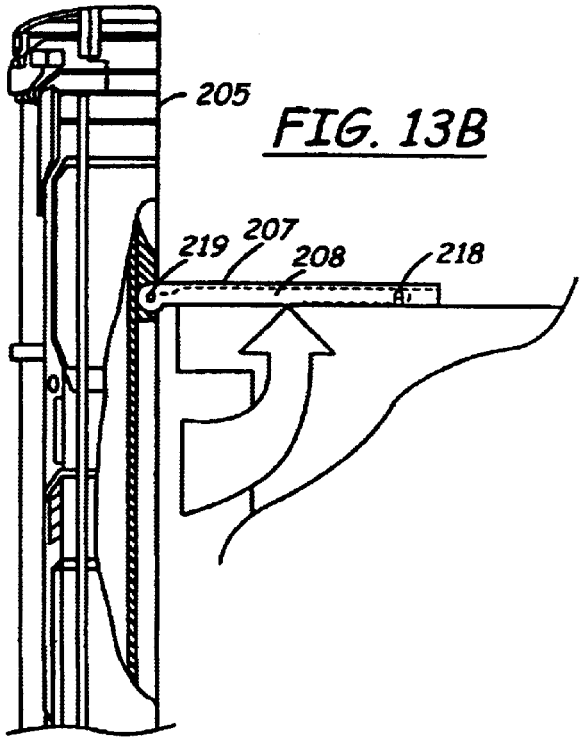
FIG. 13B
FIG. 13C
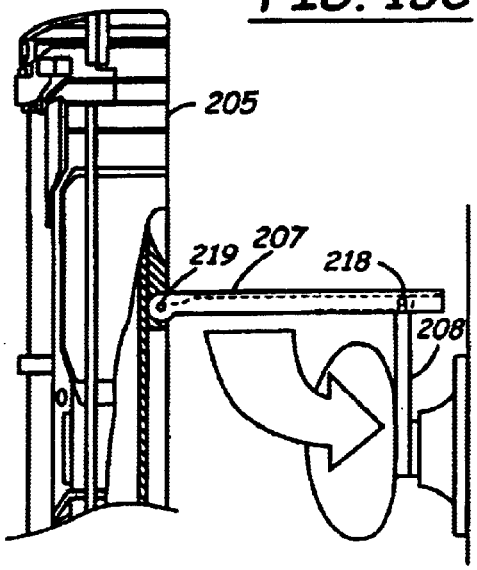

RACE CAR AND TRACK

REFERENCE TO RELATED APPLICATIONS

The present application hereby claims the benefit of co-pending provisional U.S. patent application serial No. 60/229,654, filed Aug. 31, 2000, which is hereby incorporated by reference as if fully set forth.

FIELD OF INVENTION

The invention relates generally to toys, and more particularly to a toy race car and track system having illuminated portions.

BACKGROUND

Race cars and tracks are well known in the field of toys and other amusement devices. Existing systems allow toy race cars to travel on modular tracks that confine the vehicles. Tracks in such systems often include track pieces connected by track connectors. Existing systems include loops, jumps, and intersections at which multiple vehicles may collide with each other.

Existing systems leave room for improvement. It is desirable to create newer and more improved race track systems having additional amusement features. What is needed is a track system that provides such additional features.

SUMMARY

A toy race car and track system is disclosed, wherein the race car or the track have certain portions that illuminate when in use. The car has a chassis connected to a body. The chassis supports a pull-back motor to drive wheels connected to the bottom of the chassis. The chassis also supports an electronics portion having an LED or other light source and a battery. The body generally covers the chassis, forming an inside portion. The light source illuminates the inside of the vehicle when the vehicle is moving or vibrating, using a shake sensor. The body portion has translucent windows or other portions that allow the light source to be viewed outside the car.

The track may have tunnels, loops, jumps, and other desired characteristics. One embodiment has a jump portion and a receiving tunnel system having one or more receiving tunnels that catch vehicles launched from the jump. The cars travel along the track toward and up the jump. The jump directs the cars upwardly and back toward the direction from which they arrived at the ramp in an inverted fashion, in a range of 90 to 180 degrees with respect to the original direction in which the vehicle was traveling toward the jump. The car is launched upside-down from the end of the jump, through the air, toward the tunnel system.

The tunnel system has one or more tunnels having openings that face the end of the jump. Each tunnel forms a loop and has an opening at a different height. The tunnels catch the cars launched from the jump and redirect the cars back toward the jump. The jump-tunnel combination generally forms a "loop" for the cars' travel wherein the loop has an open top portion at which point the cars travel through the air from the jump end to a tunnel opening. The speed of the car at the jump determines which tunnel will receive the car. At a car's top speed, the outer tunnel having the upper-most opening will receive the car and redirect it toward the jump in one embodiment. The car may lose speed after the first loop and might be directed to a lower opening of an inner tunnel after its second launch from the jump. This process repeats until the car has traveled through all loops and has lost its speed. The end of the final tunnel may have a catch for stopping the car and holding it in place when the cycle is completed. The end of the jump may have a pitch adjuster to change the launch angle. The tunnel and jump system may be combined with other track elements and features as desired, such as a loop or a 180-degree horizontal turn. The tunnel system or any other portion of the track system may include a lighting system, such as one that uses a shake sensor to light a portion of the track when a car is in use.

The track may be designed for two or more vehicles to be used at the same time and may allow the vehicles' paths to intersect such that the vehicles may sometimes crash. One embodiment of the track system has two or more start gates that start the cars moving forward down separate portions of the track. The cars travel down separate track portions through loops and curves. Traveling away from the start gates, the separate track portions rise, forming loops, and turn toward each other, intersecting at a first "criss-cross" intersection near a point at which the driving surface of each track is approximately vertical. Each respective track portion continues through the first criss-cross intersection, forms a loop, and reaches a second criss-cross intersection at the downward portion of the respective loops, again near a point at which the driving surface of the track is approximately vertical, but at which cars on both tracks are on the downward portion of their respective tracks. Each respective track portion continues through the second intersection, completes the loop, and forms a 180-degree horizontal turn.

After the turn, the respective portions of the track are substantially parallel to each other and each enters a criss-cross loop. The criss-cross loop is as wide as at least two cars and in one embodiment has the width of approximately three cars. The criss-cross loop receives each of the separate track portions such that both cars may be on the same loop surface, traveling in the same general direction, at the same time. The criss-cross loop guides the cars toward each other, thereby causing the paths of cars on separate track portions to intersect inside the loop, possibly while the cars are upside down, and then directs the cars through the loop and funnels the cars out a one-car-wide exit lane. The loop may be made of a clear material so that a user can view the vehicles while in the loop. The track system is designed such that the vehicles travel primarily on separate tracks, but may crash into each other in at least three places—the two criss-cross intersections and the criss-cross loop.

One embodiment of the track system may also include a jump portion that shows how high a car jumps in the air at the end of a jump on the track. The jump portion receives a track on which a car may be traveling. The track rises until it is near vertical. At the vertical portion, the track has a transparent gauge with numbers on its outside. The gauge generally forms half of a cylinder around the top portion of the track and runs along the vertical end portion of the track for a desired length. The gauge covers the top of the track, thereby preventing cars from falling backward off of the track. A user can measure the height of a car's jump by viewing the car in the gauge portion and using the numbers to measure the jump. In order to position the track in a vertical manner, the end of the track or the gauge portion may include a hook capable of engaging a door knob, a table, or other suitably high surface or connector.

The gauge portion may include LEDs or other light sources that are activated when the track is in use or when a car has reached the vertical portion using, for example, a shake sensor. The gauge includes a lighted sign at the top that has multiple adjacent pieces that separate when a car travels to the top of the gauge, giving the impression that the car has caused the sign to explode. In one embodiment, the track may also include a loop before the car reaches the jump.

SUMMARY OF DRAWINGS

FIGS. 13*a–c* show the use of the counter rest and doorknob catch shown in FIGS. 6*a–b* and 7*a–b*.

DETAILED DESCRIPTION

Figures 1, 2, 3A:
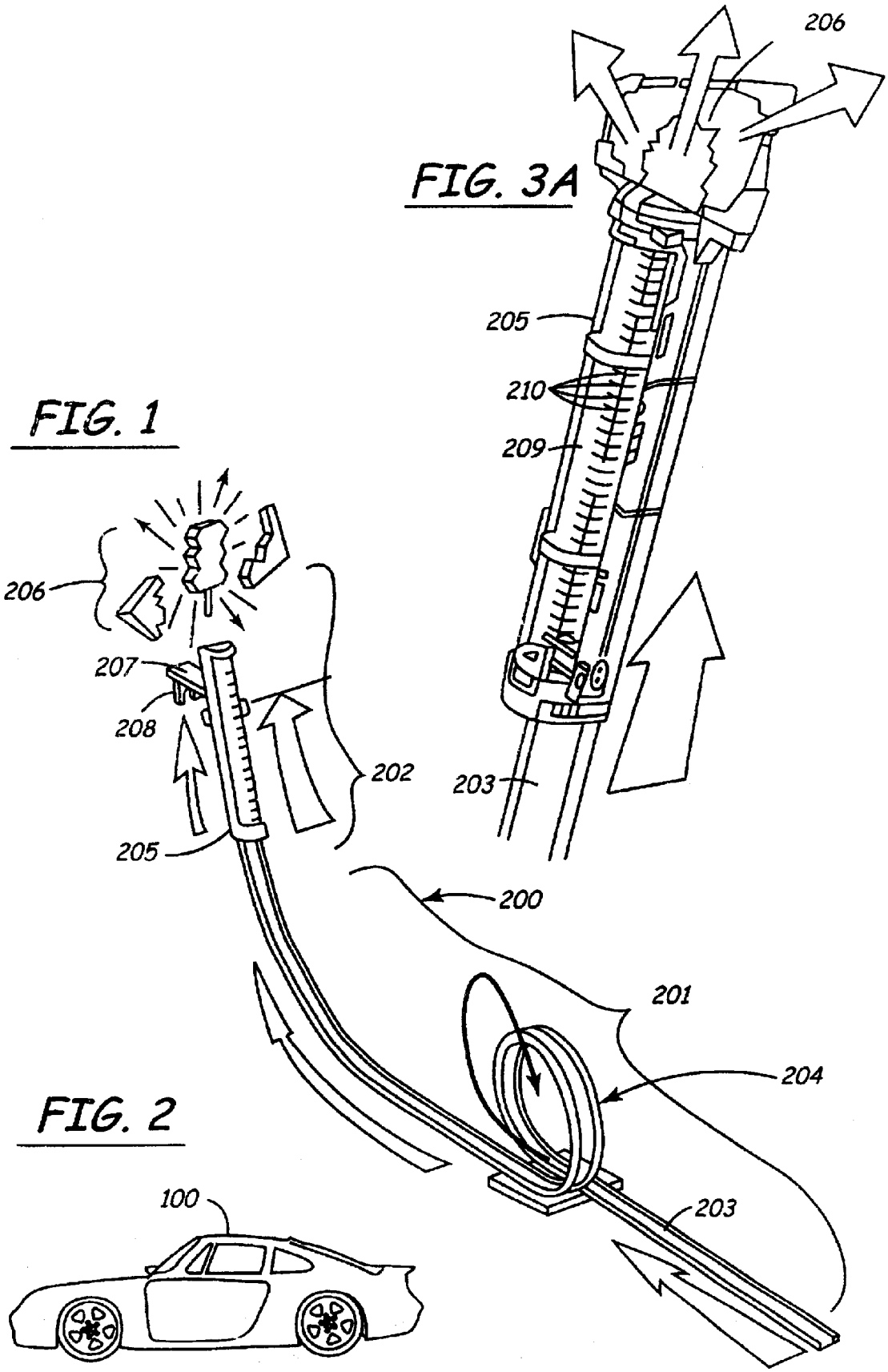
FIG. 1 shows one embodiment of the track system.
FIG. 2 shows a vehicle used with the track system.
FIGS. 3*a–f* show the gauge used with the track system shown in FIG. 1.
Figure 3B:
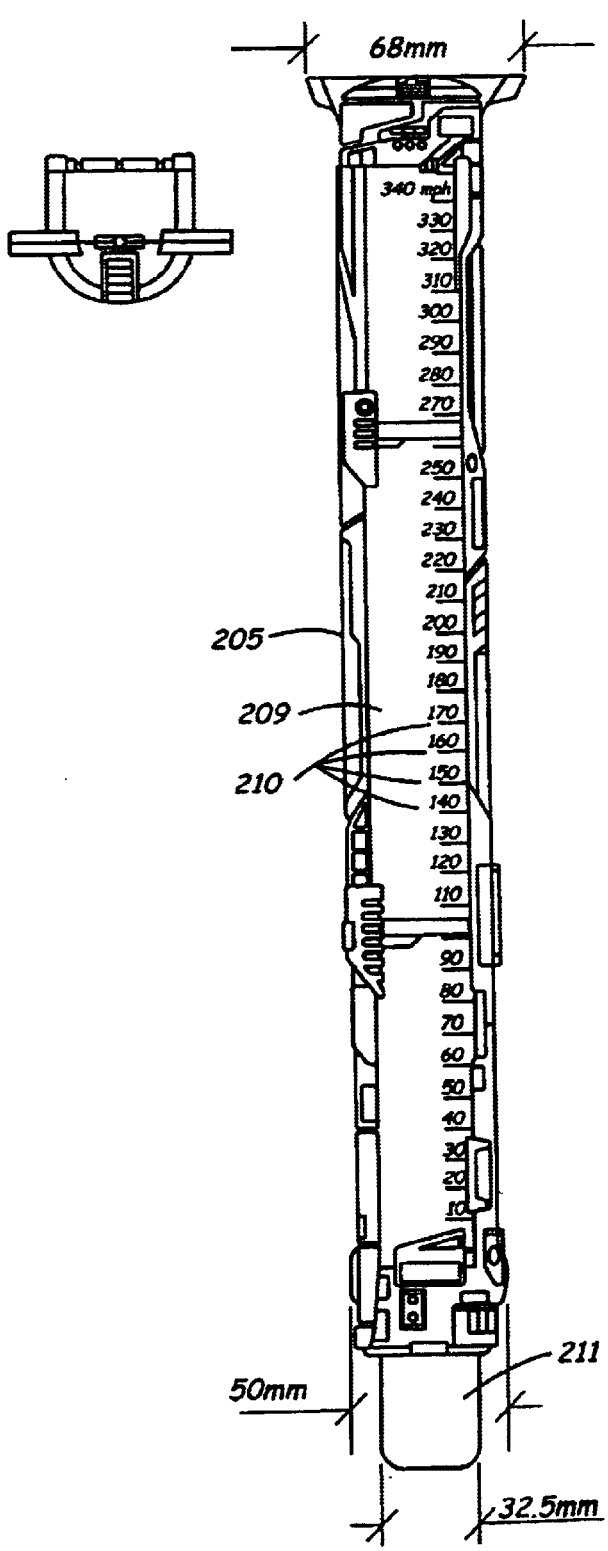

FIG. 1 shows a race track 200 having a track portion 201 that rests on a horizontal surface such as a floor. The track portion 201 is connected to a jump portion 202 that extends upward from the horizontal surface on which the track portion 201 is used. In the example shown in FIG. 1, the track portion 201 has a track 203 that confines a toy race car on an operating surface of the track 203. The track portion 201 also includes a loop 204 formed from the track 203. In use, a toy vehicle traveling along the track 203 is directly through the loop 204 such that centripetal force holds the vehicle to the track 203 through the loop 204. The track 203 of the track portion 201 bends upwardly as a vehicle enters the jump portion 202. The jump portion 202 includes a gauge 205 for measuring the height of the jump by the vehicle. The gauge 205 may be a clear plastic tube having markings or other indicators showing how far into the gauge 205 the vehicle goes on a jump before falling backward to the ground. The jump portion 202 includes a sign 206 attached the gauge 205.

The gauge 205 has a first end through which the vehicle enters the gauge 205 and a second end to which a sign 206 is attached. When a vehicle traveling on the race track 200 reaches the second end of the gauge 205, the sign 206 illuminates, becomes dislodged from the gauge 205, and breaks into multiple pieces. The jump portion 202 of the race track 200 is adapted to attach to a table, wall, doorknob, or other surface in order to extend the jump portion 202 vertically. In the example shown in FIG. 1, the jump portion 202 includes a counter rest 207 that is hingedly connected to the gauge 205. The counter rest 207 may be folded in a storage position, or it may be extended as shown in FIG. 1 to rest, for example, on a flat surface such as a countertop or table. Also in the example shown in FIG. 1, the jump portion 202 includes a doorknob catch 208. The doorknob catch 208 is hingedly connected to the counter rest 207 such that both the counter rest 207 and the doorknob catch 208 may be folded in a storage position. In the example shown in FIG. 1, the doorknob catch 208 is extended in order to engage a doorknob. The doorknob catch 208 includes an opening adapted to hold the jump portion 202 to a doorknob.

FIG. 2 shows a toy race car 100 that may be used on the race track shown in FIG. 1. As used herein, the terms car, race car, and vehicle are used interchangeably and refer to any object adapted for travel on the toy race track system. In one example, the toy race car 100 includes a pull-back motor that allows a user to wind up the race car 100 by rolling its wheels backward. The user may then release the vehicle causing it to go forward. In one embodiment, the vehicle using a pull-back motor in a pre-wound state remains stationary until it is urged forward, for example, by a start gate. In other examples, the race car 100 may not include a motor or may include a different type of motor. The race car 100 may be propelled manually by a user or may be propelled using starters described herein.

FIG. 3*a* shows a more detailed diagram of the gauge 205 shown in FIG. 1. The gauge 205 has a first end that connects to the track 203 and receives a race car 100 traveling on the track 203. The second end of the gauge 205 includes a sign 206 which may include a lighted portion that illuminates when the vehicle reaches the top of the gauge 205. The light source on the sign 206 may be activated, for example, by a shake sensor that detects when the vehicle 100 approaches the sign 206. The gauge 205 includes a front portion 209 having markings 210 that indicate the height of the vehicle 100 in the gauge 205. In one example, the front portion 209 of the gauge 205 may be made from a translucent or transparent material, and the markings 210 may be permanent markings affixed to the front portion 209, such that the user is able to view the vehicle 100 traveling through the gauge 205 to determine how high within the gauge 205 the vehicle 100 travels. If the vehicle 100 reaches the second end of the gauge 205, it triggers the sign 206 to "explode" by detaching from the gauge 205 and breaking into multiple pieces.

Figure 3C:
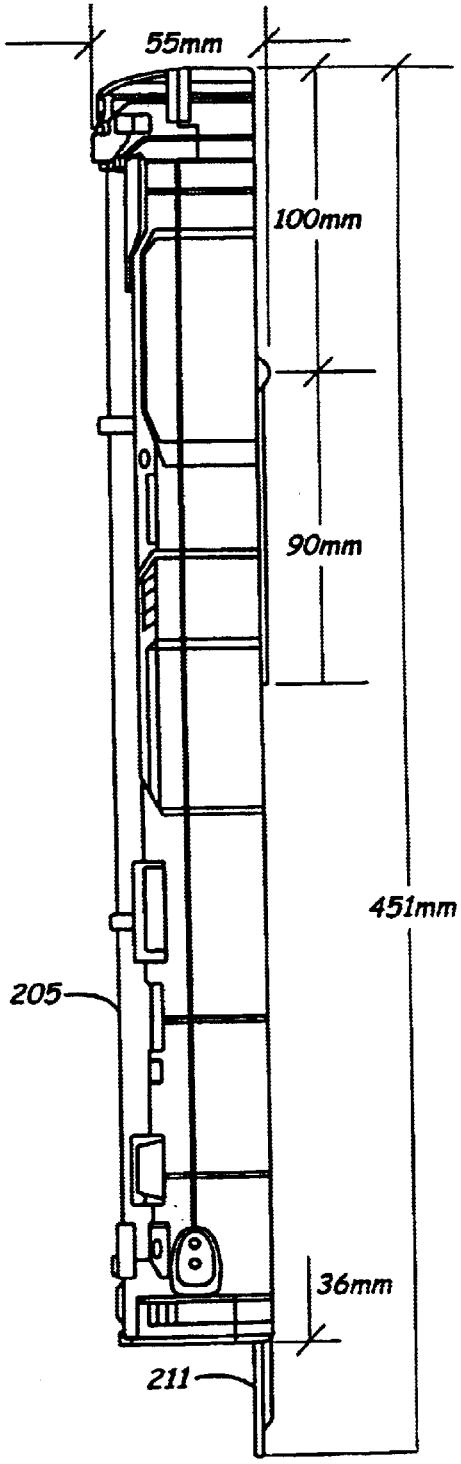
Figure 3D:
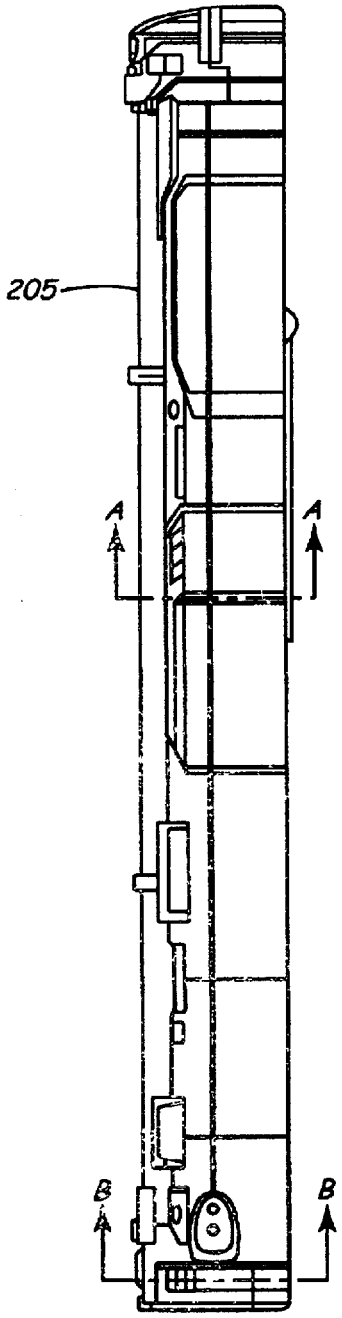

FIGS. 3*b* through 3*f* show greater detail of the gauge 205 shown in FIG. 1. As described, the gauge 205 may include a front portion 209 that is clear and has markings 210 for indicating the height of a vehicle 100 traveling through the gauge 205. The gauge 205 may also have a track connector 211 at the first end for engaging the track 203. The track connector 211 allows the gauge 205 to removably attach to the track 203. FIG. 3*c* shows a side view of the gauge 205 shown in FIG. 3*b*. FIG. 3*d* shows another view of the gauge 205 shown in FIG. 3*b*.

Figure 3E:
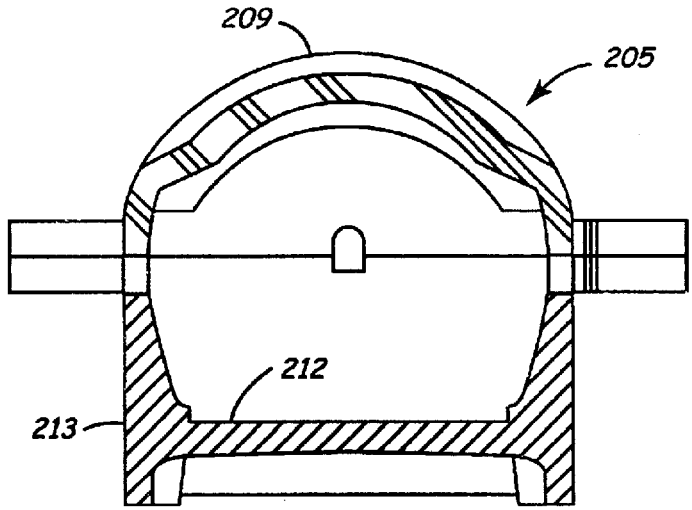
Figure 3F:
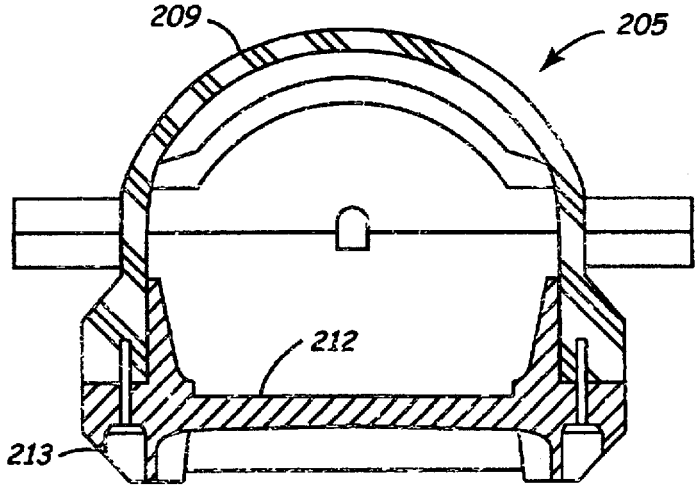

FIGS. 3*e* and 3*f* show cross-sections of the gauge 205 taken along the lines A—A and B—B shown in FIG. 3*d*, respectively. As shown in FIGS. 3*e* and 3*f*, the gauge 205 may be formed from two parts, a front portion 209 and a rear portion 213. As shown in FIG. 3*f*, the front portion 209 and rear portion 213 may be connected using conventional connectors such as screws 1. Also shown in FIGS. 3*e* and 3*f*, the rear portion 213 inside the gauge 205 includes a substantially flat tunnel plate 212. The tunnel plate 212 may align flush with the track 203 as the track 203 connects to the gauge 205 via the track connector 211. The allows a vehicle 100 traveling along the track 203 entering the gauge 205 to continue traveling along a substantially flat surface as it proceeds through the gauge 205.

Figure 4B:
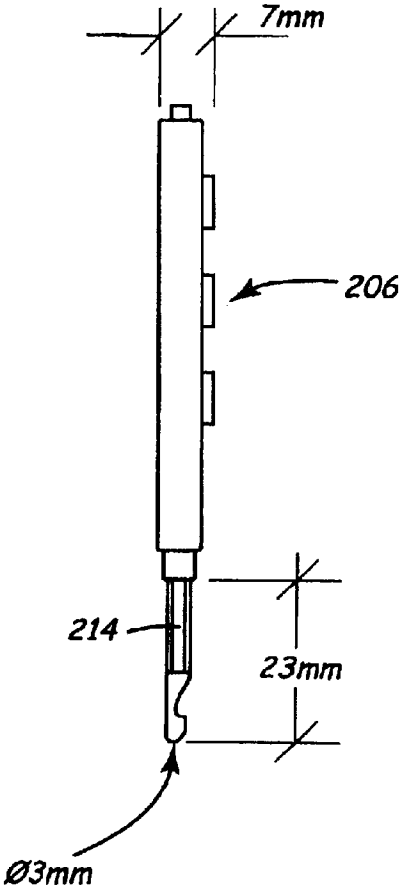
FIGS. 4*a–c* show the sign shown in FIG. 1.
Figure 4A:
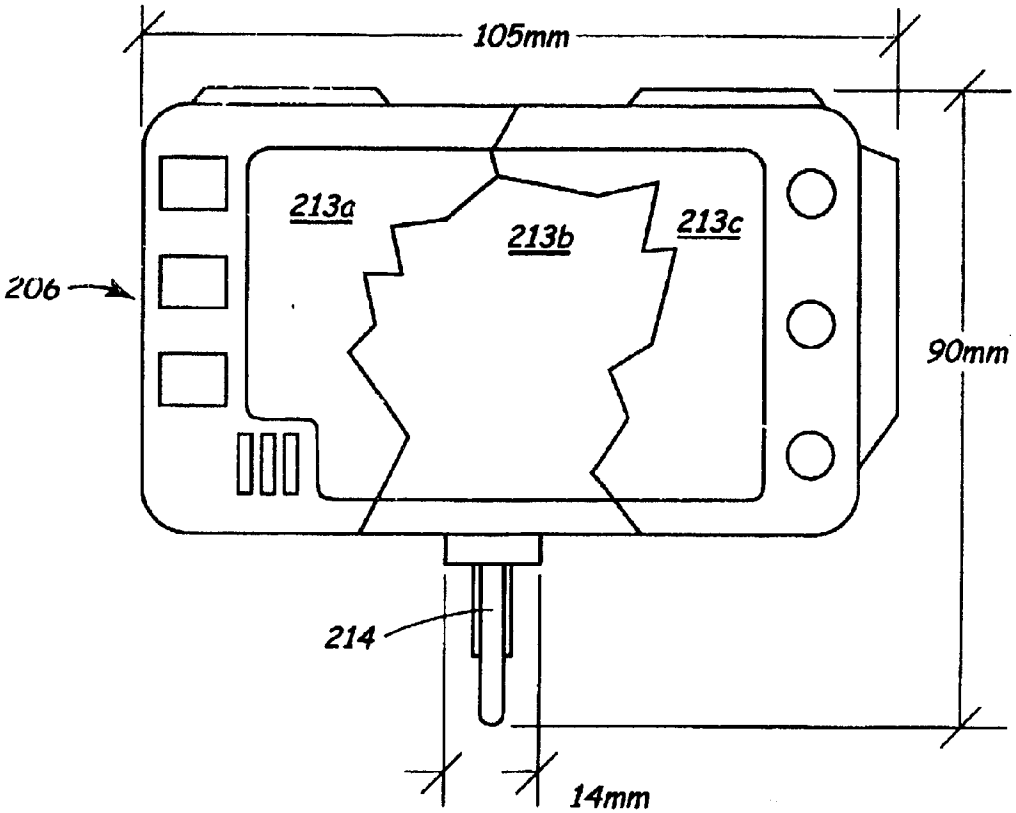
Figure 4C:
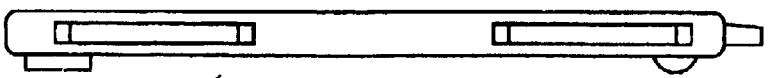

FIGS. 4*a* through 4*c* show more detailed view of the sign 206 shown in FIG. 1. The sign 206 includes multiple breakaway pieces 213*a*, 213*b*, 213*c* that come apart when the sign 206 disengages the gauge 205. The breakaway pieces 213*a*, 213*b*, 213*c* are pre-formed and are adapted to fit back together so that the sign 206 may be reused multiple times. The sign 206 also includes any elongated connector 214 for connecting the sign 206 to the gauge 205. The elongated connector 214 includes a notch that connects to the gauge 205, held in place by a spring, described herein.

Figure 5A:
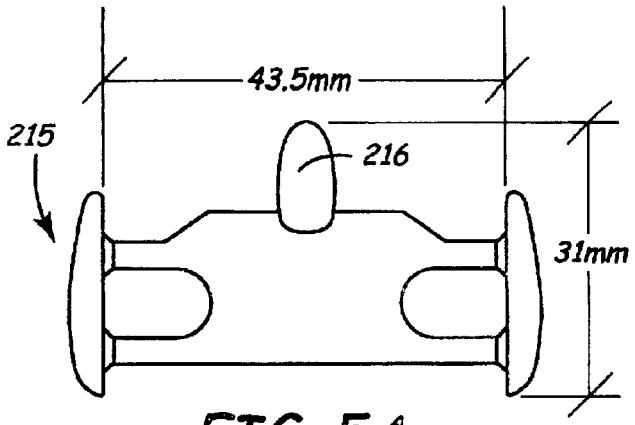
FIGS. 5*a–c* show the tunnel runner used in conjunction with the track shown in FIG. 1.
Figure 5B:
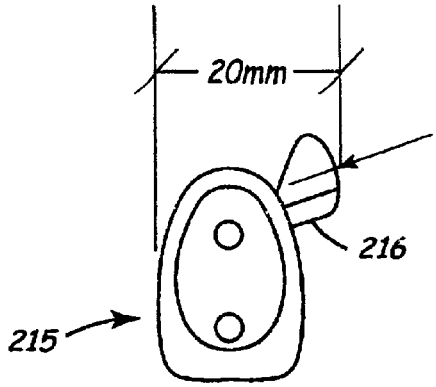
Figure 5C:
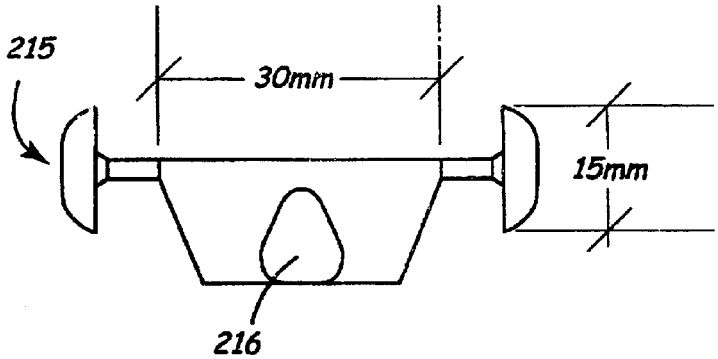

FIGS. 5*a* through 5*c* show views of a tunnel runner 215. Tunnel runner 215 fits loosely within the gauge 205 and receives the vehicle 100 as it proceeds through the gauge 205. The tunnel runner 215 includes a cam 216 adapted to engage the elongated connector 214 of the sign 206. As the vehicle 100 enters the gauge 205, the vehicle 100 engages the tunnel runner 215 and proceeds to travel through the gauge 205 with the tunnel runner 215 positioned at the front of the vehicle 100. As the vehicle 100 and the tunnel runner 215 approach the second end of the gauge 205, the cam 216 of the tunnel runner 215 contacts the elongated connector 214 of the sign 206 causing the sign 206 to dislodge from the gauge 205, which in turn causes the individual breakaway pieces 213*a*, 213*b*, 213*c* to separate. The cam 216 has a rounded surface that urges the notch of the elongated connector 214 away from the gauge 205.

Figure 6A:
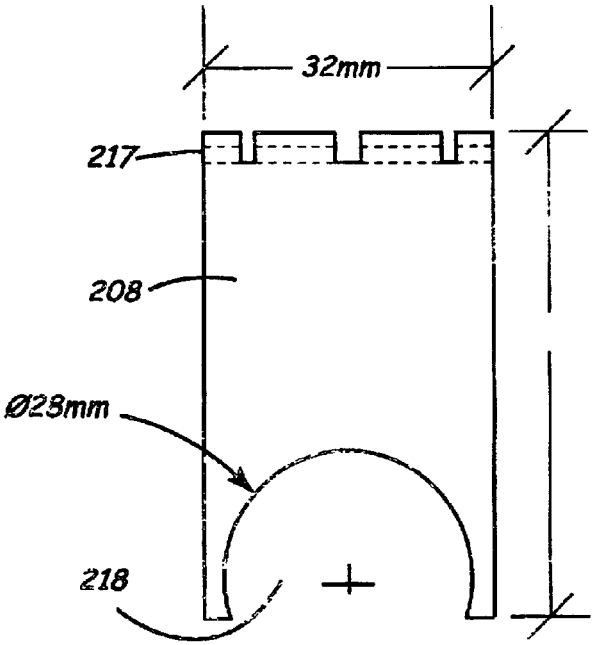
FIGS. 6*a–b* show the doorknob catch used with the track system shown in FIG. 1.
Figure 6B:
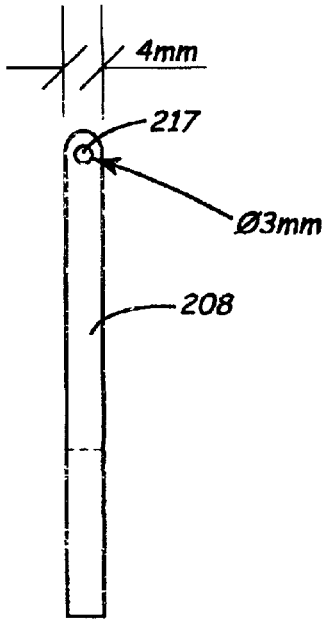

FIGS. 6*a* and 6*b* show more detailed views of the doorknob catch 208 shown in FIG. 1. The doorknob catch 208 has a pivotal connector 217 that allows the catch 208 to fold into a storage position. The pivotal connector 217 connects to counter rest 207 in one embodiment, such as the embodiment shown in FIG. 1. The doorknob catch 208 defines an opening 218 adapted for receiving a doorknob or similarly shaped object. In use with a doorknob, the catch 208 is extended so that it is substantially vertical and substantially parallel to a door on which the doorknob is located. The opening 218 engages the doorknob, holding the track system 200 in place with the jump portion 202 extended upwardly.

Figure 7A:
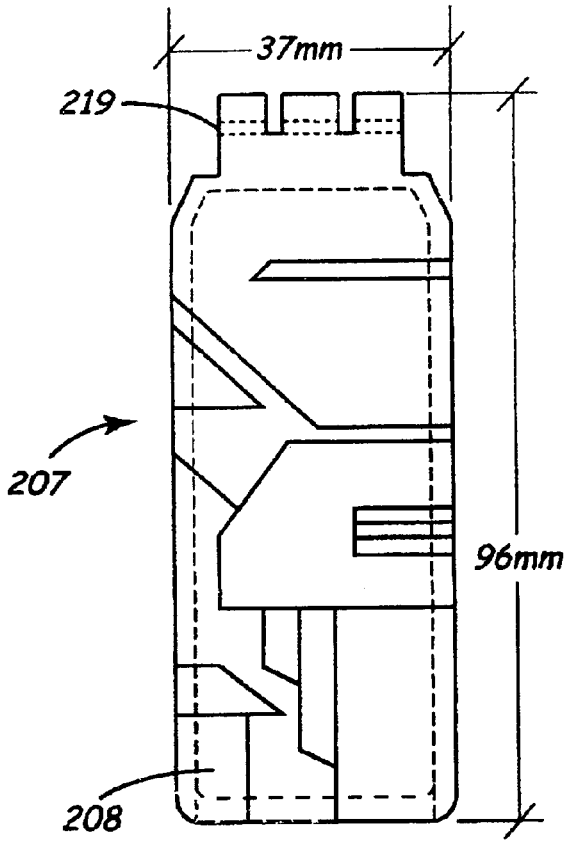
FIGS. 7*a–b* show the counter rest used with the track system shown in FIG. 1.
Figure 7B:
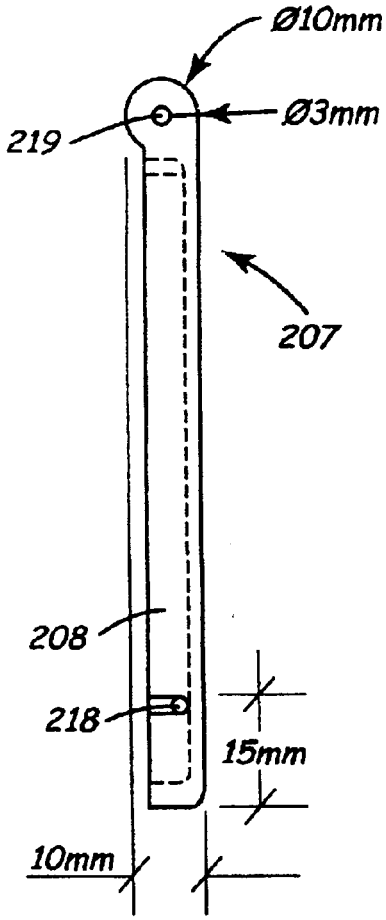

FIGS. 7*a* and 7*b* show more detailed views of the counter rest 207 shown in FIG. 1. In the examples of FIGS. 7*a* and 7*b*, the counter rest 207 includes a pivotal connector 219 and pivotally connects to the gauge 205. The pivotal connector 219 allows the counter rest 207 to fold into a storage position substantially parallel to the length of the gauge 205 when not in use. Also in the example of FIGS. 7*a* and 7*b*, the counter rest 207 contains the doorknob catch 208, as shown in dashed lines. As shown in FIGS. 7*a* and 7*b*, the doorknob catch 208 is folded about the pivotal connector 218 that pivotally connects the counter rest 207 with the doorknob catch 208, such that the doorknob catch 208 is contained entirely within the counter rest 207 in the folded position. In use, both the counter rest 207 and the doorknob catch 208 may be extended to engage a doorknob or similar object. In another use, the doorknob catch 208 may remain folded within the counter rest 207, and the counter rest 207 may be extended, for example, to engage a horizontal surface above the floor such as a counter or table. In one embodiment, one side of the counter rest 207 may include a surface with suitable friction to hold the track system 200 to a table or countertop. The friction surface may be, for example, a surface of the doorknob catch 208.

Figure 8A:
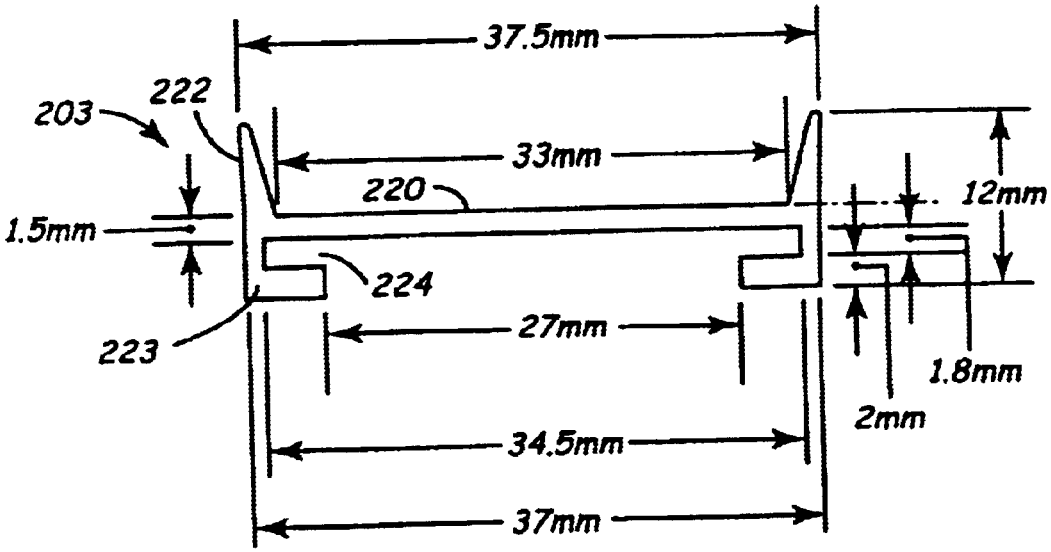
FIGS. 8*a–b* show the track on which the vehicle travels.
Figure 8B:
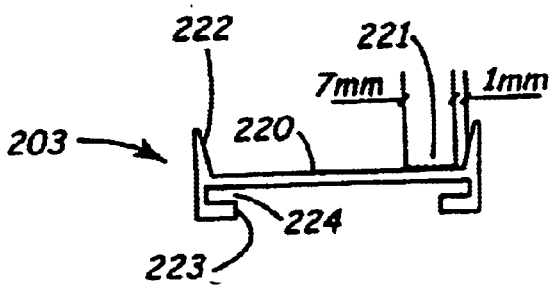

FIGS. 8*a* and 8*b* show more detailed views of the track 203 shown in FIG. 1. The track 203 includes an operating surface 220 on which vehicles 100 travel. The track 203 also includes sidewalls 222 or other guide means that contain the vehicle 100 on the operating surface 220 of the track 203. The track 203 also includes track connecting portions 223 on the underside of the track 203. The track connecting portions 223 define openings 224 that may be used, for example, to receive a piece of material such as a track connector described herein, that connects adjacent tracks. FIG. 8*b* shows an alternative embodiment of the track surface 220 in which a portion of the track surface 220 includes a textured portion 221. Part or all of the track surface 220 may include the textured portion 221, which may be used to hold the vehicle 100 to the track surface 220. The textured portion 221 has a coefficient of friction greater than a non-textured track surface 220. The textured portion 221 may be created, for example, using a sandblasting, chemical etching, or other conventional process.

Figure 9:
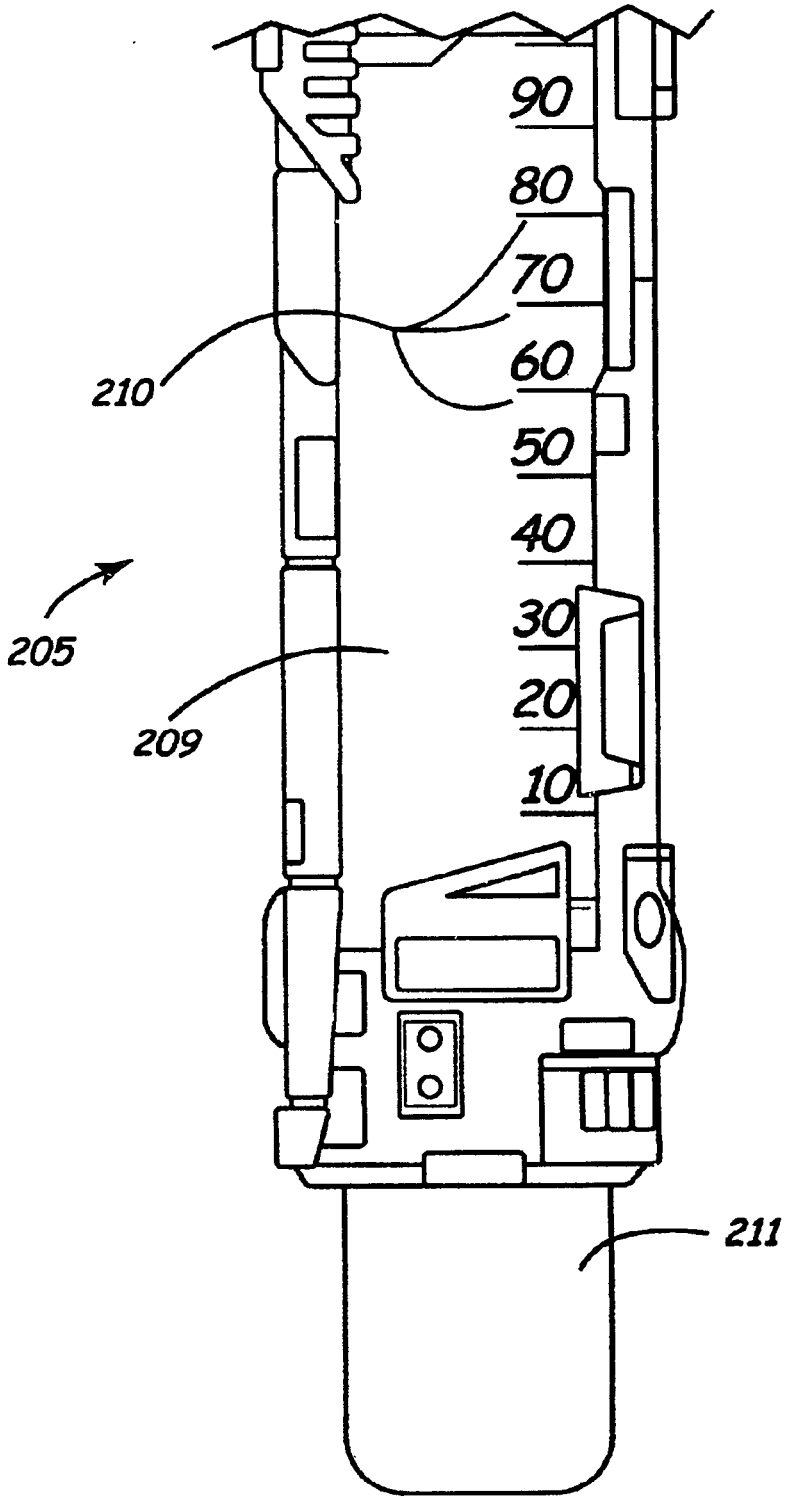
FIG. 9 shows a more detailed diagram of the gauge shown in FIG. 3*a–f*.

FIG. 9 shows a more detailed diagram of the first end of the gauge 205. The gauge 205 has a clear plastic front portion 209 with indicators 210 showing how high a vehicle travels through the gauge 205. The gauge 205 also includes a track connector 211 that connects to a piece of track 203 at the first end of the gauge 205. In one embodiment, the track connector 211 may be molded directly to the gauge 205, for example to the back portion 213 of the gauge 205 shown in FIGS. 3*e* and 3*f*.

Figure 10:
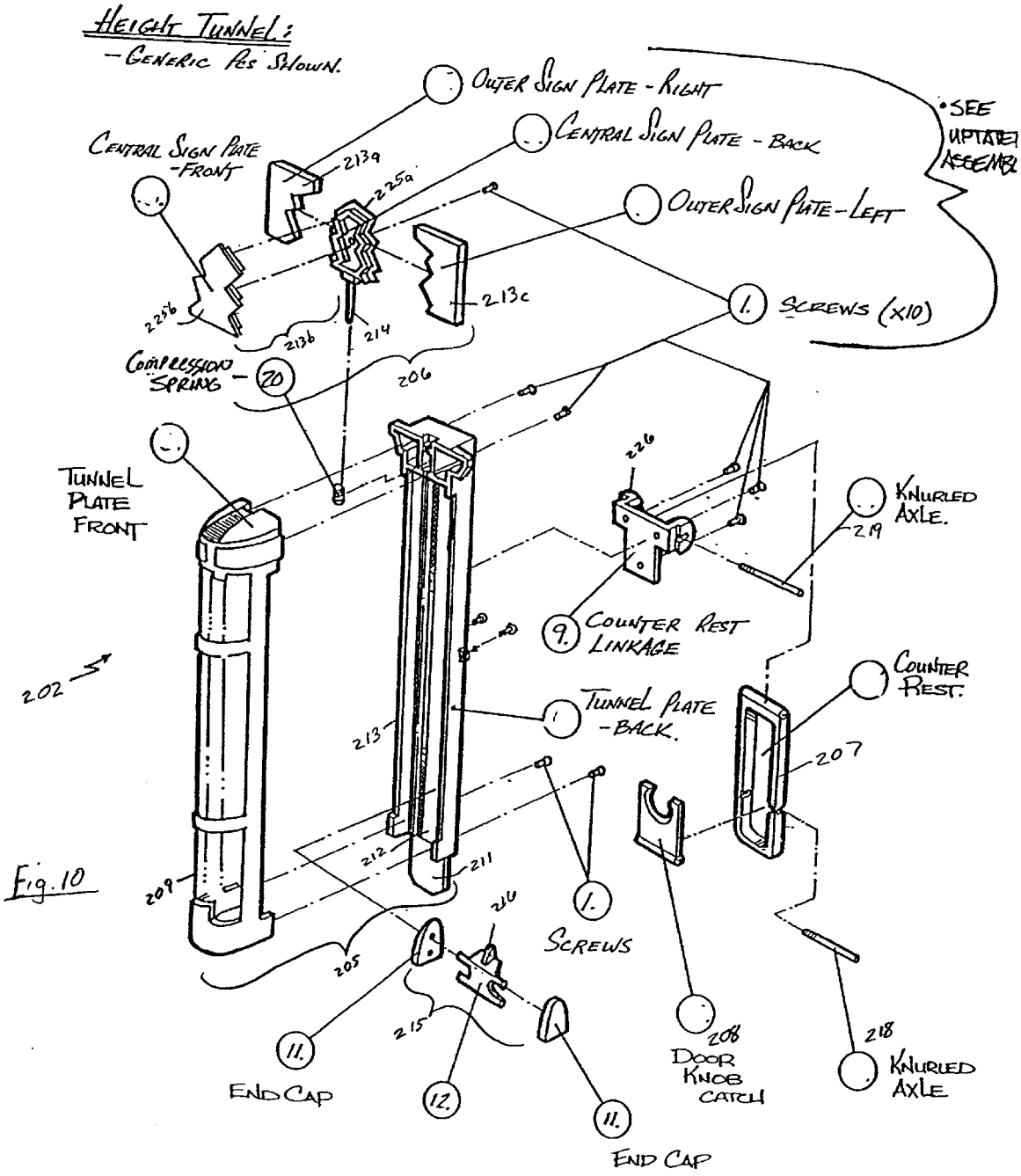
FIG. 10 shows an assembly view of the gauge shown in FIGS. 3*a–f*.

FIG. 10 shows a more detailed diagram of the jump portion 202 and its assembly. The jump portion 202 includes a gauge 205 having a front portion 209 and a rear portion 213. The rear portion 213 has a track connector 211 connected near the entrance, or first end, of the gauge 205 for connecting a track portion 203 to the gauge 205. Vehicles 100 traveling on the track 203 are directed onto a rear surface 212 on (or near) which they travel through the gauge 205. The gauge 205 also includes a compression spring 20 near the second end of the gauge 205. The compression spring 20 engages the elongated connector 214 of the sign 206 and causes the sign 206 to eject from the gauge 205 when the spring is extended, for example, when the car 100 reaches the second end of the gauge 205. Force from the spring 20 also holds the elongated connector 214 of the sign 206 in a locked position before a vehicle 100 arrives.

The sign 206 includes breakaway portions 213*a*, 213*b*, 213*c* that come apart when the sign 206 is detached from the gauge 205. The center breakaway portion 213*b* is connected to the elongated connector 214 and includes a front side 225*b* and a rear side 225*a*. In use, the front and rear sides 225*a* and 225*b* remain connected when the sign 206 is detached from the gauge 205.

A tunnel runner 215 is positioned inside the gauge 205 and engages a vehicle 100 traveling through the gauge 205. The tunnel runner 215 travels through the gauge 205 in front of the vehicle 100 and triggers the compression spring 20, causing it to expel the sign 206. The tunnel runner 215 includes a central portion 12 and two end caps 11. The central portion 12 of the tunnel runner 215 includes a cam 216 that causes the sign 206 to release from the gauge 205 if the vehicle 100 travels the length of the gauge 205.

Counter rest linkage 9 connects the gauge 205 to the counter rest 207 by pivotal connector 219 that allows the counter rest 207 to fold into a folded position substantially parallel to the length of the gauge 205. Also shown in FIG. 10, a doorknob catch 208 is pivotally connected by a pivotal connector 218 to the counter rest 207 and fold within the counter test 207 in one embodiment. The various portions of the jump assembly 202 may be connected, for example, by common screws 1.

Figure 11:
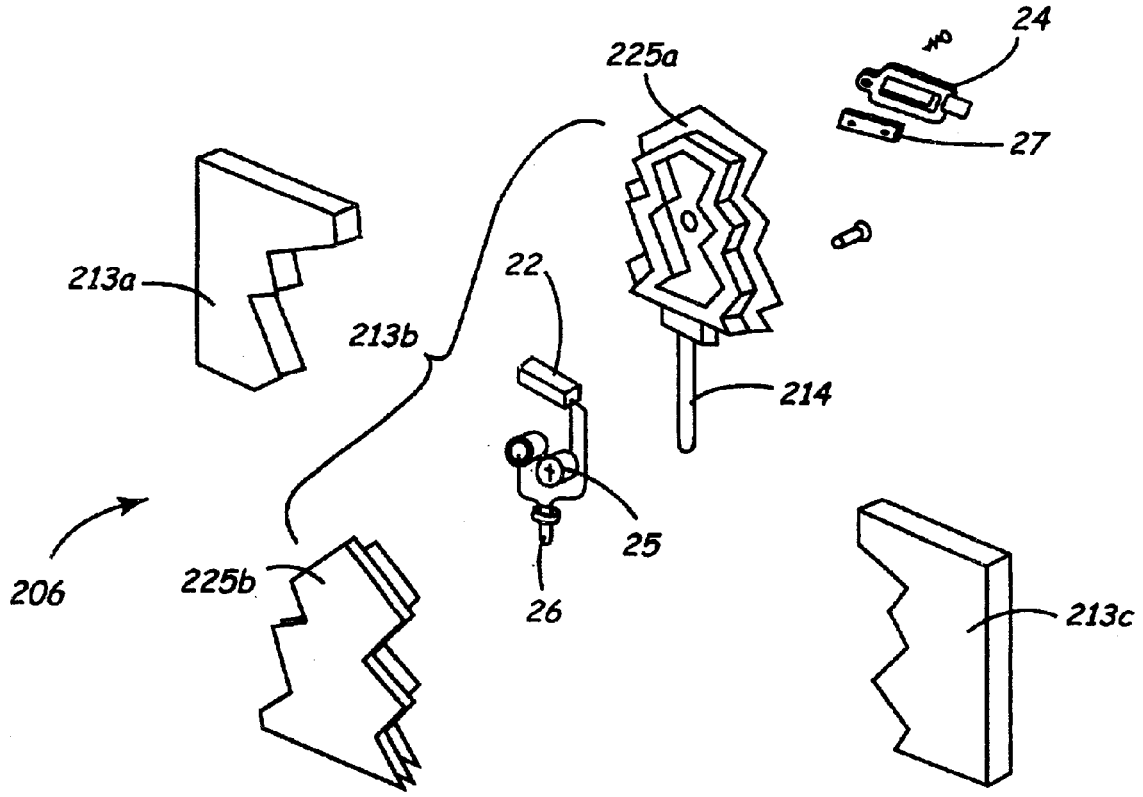
FIG. 11 shows a more detailed view of the sign shown in FIGS. 4*a–c*.

FIG. 11 shows a more detailed diagram of the sign 206 shown in FIG. 1. The sign 206 includes breakaway pieces 213*a*, 213*b*, 213*c*. Central breakaway piece 213*b* is connected to an elongated connector 214 that releaseably connects to the gauge 205. Central breakaway piece 213*b* includes a front portion 225*b* and a rear portion 225*a* that contain a light source 26, such as a light-emitting diode (LED). The light source 26 is powered by a power source 25, such as batteries 25, and is connected to a shake sensor 22. The shake sensor 22 senses movement near the sign 206, such as movement caused by vehicle 100 traveling through the gauge 205 near the sign 206. Upon sensing such movement, the shake sensor 22 electrically connects the power source 25 to the light source 26, which causes the light source 26 to illuminate the sign 206. In one embodiment, the light source 26 may flicker on and off. Also shown in FIG. 11, the sign 206 includes a battery cover 24 and a contact plate 27 for holding the batteries 25 and the sign 206.

Figures 12A, 12B:
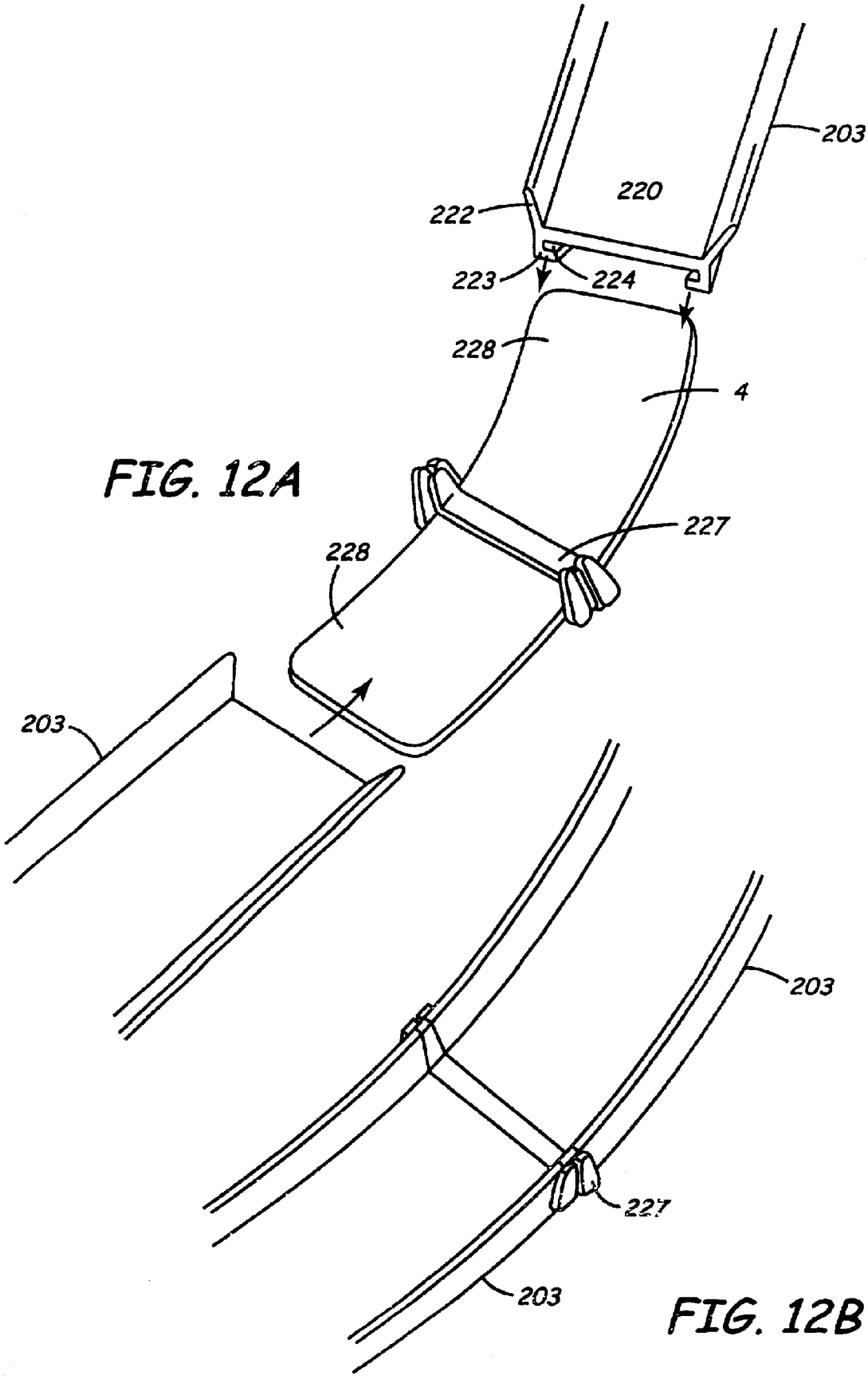
FIGS. 12*a–b* show the connection between pieces of track.

FIGS. 12*a* and 12*b* show a more detailed diagram of the track 203 shown in FIG. 1, and particularly shows the connection between two tracks 203, for example, in the loop 204. FIG. 12*a* shows the track connector 4, also referred to as the loop connector 4, as a male connector 228 that engages the track connectors 223 and the openings 224 formed thereby to connect adjacent track portions 203. FIG. 12*b* shows the connection between the two adjacent tracks 203 separated by a wedge 227 of the loop connector 4. The wedge 227 holds the track walls 222 substantially flush with each other.

FIGS. 13*a* through 13*c* show use of the counter rest 207 and doorknob catch 208. FIG. 13*a* shows the counter rest 207 and doorknob catch 208 pivoted about their respective pivotal connectors 218, 219 into a folded position for storage. FIG. 13*b* shows use of the track system 200 with a countertop, table, or other similar raised horizontal surface. The counter rest 207 is pivoted about its pivotal connection 219 such that it is substantially perpendicular to the length of the gauge 205. The connection between the counter rest 207 and the gauge 205 may include a stop that prevents the counter rest 207 from rotating beyond a specified angle, for example, 90 degrees up from the storage position. In FIG. 13*b*, the doorknob catch 208 remains stored within the counter rest 207 because it is not in use. FIG. 13*c* illustrates use of the doorknob catch 208 engaging a doorknob. The doorknob catch 208 is pivoted about its pivotal connection 218 to the counter rest 207 into an extended position. The connection between the doorknob catch 208 and the counter rest 207 may include a stop that locks the doorknob catch 208 into position relative to the counter rest 207 or the gauge 205, such as a stop that prevents the doorknob catch 208 from pivoting about its pivotal connection 218 beyond a specified angle, such as 90 degrees from the storage position.

Figure 14A:
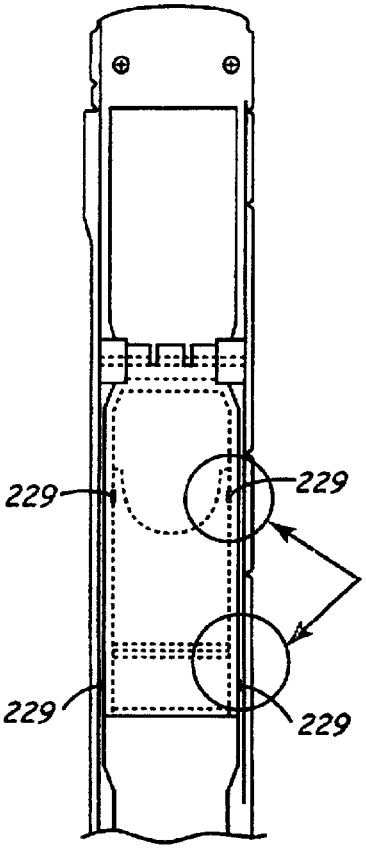
FIGS. 14*a–e* show a locking mechanism that may be used with the doorknob catch and counter rest.
Figure 14B:
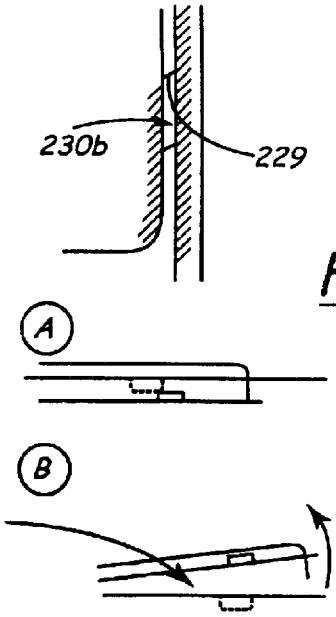
Figure 14D:
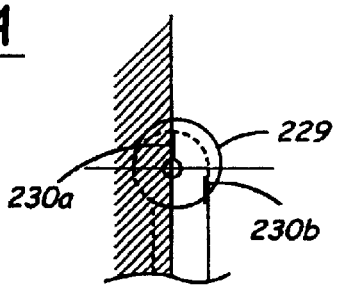
Figure 14E:
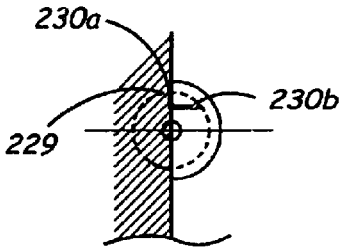
Figure 14C:
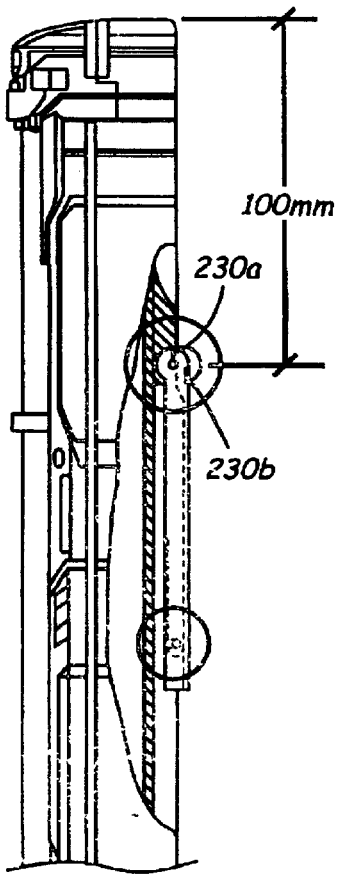

FIGS. 14*a* through 14*e* show one embodiment of a lock 229 that is used to hold the counter rest 207 or doorknob catch 208 in position, or to prevent these items from extending beyond a specified range of motion. The locks 229 include pairs of lock mechanisms 230*a*, 230*b* which may be pieces of material formed to limit movement about the pivotal connectors 218, 219 as shown in FIGS. 14*d* and 14*e*.

Figure 15A:
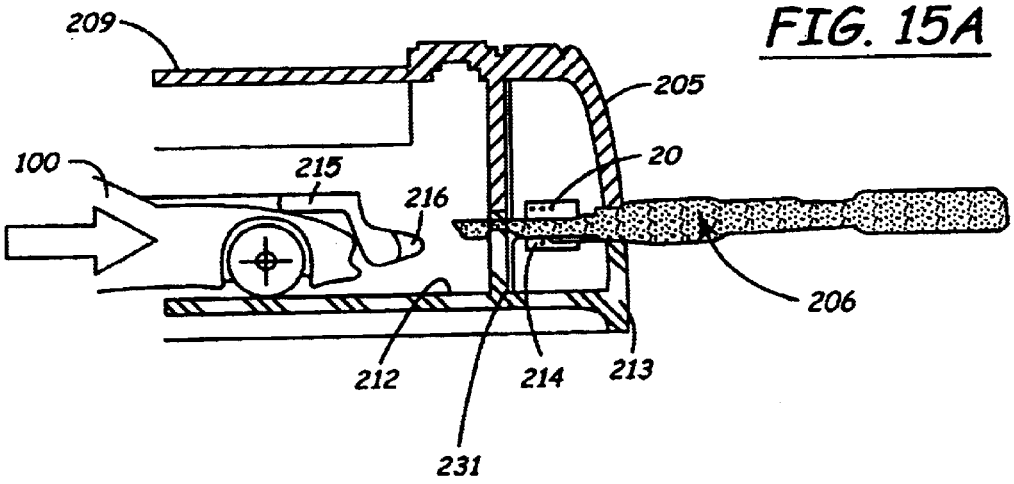
FIGS. 15*a–c* show the connection between the sign and the gauge in use with a vehicle.
Figure 15B:
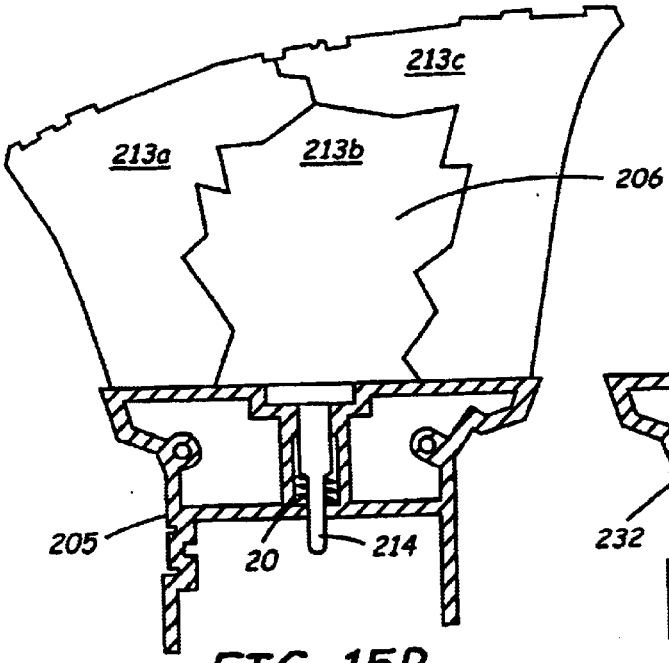
Figure 15C:
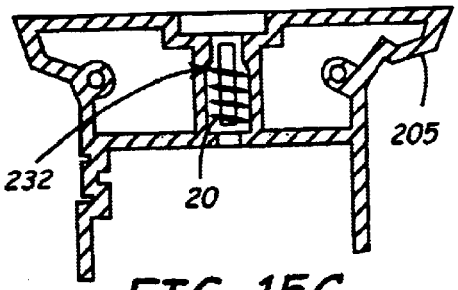

FIGS. 15*a* through 15*c* show the connection between the sign 206 and the gauge 205. The elongated connector 214 of the sign 206 protrudes through the end of the gauge 205 through the compression spring 20 that urges the sign 206 outward from the gauge 205. As a vehicle 100 travels through the gauge 205 on or near the rear surface 212, the vehicle 100 contacts the tunnel runner 215 and pushes it through the gauge 205 toward the sign 206. The cam 216 of the tunnel runner 215 makes contact with the sign 206 causing it to release from the spring 20 and detach from the gauge 205. The elongated connector 214 of the sign 206 includes a notch 231 that holds the sign 206 in place in the gauge 205 using the tension of the spring 20. When the cam 216 hits the elongated connector 214, the notch 231 is urged away from its position, and the spring 20 releases the sign 206 from the gauge 205. FIG. 15*b* shows another view of the connection between the sign 206 and the gauge 205. The sign 206 includes breakaway pieces 213*a* through 213*c*. The elongated member 214 extends into the end of the gauge 205. FIG. 15*c* shows an embodiment of the gauge 205 in which the sign 206 has been expelled, and the spring 20 has moved to its static position. Tabs 232 hold the spring 20 in place within the gauge 205.

Figure 16A:
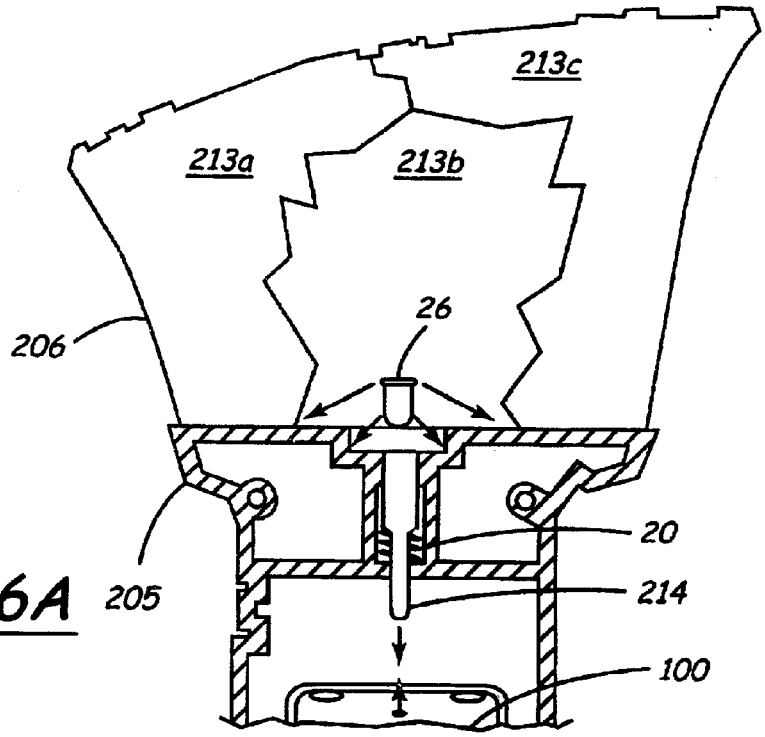
FIGS. 16*a–b* show more detailed views of the sign shown in FIGS. 15*a–c*.
Figure 16B:
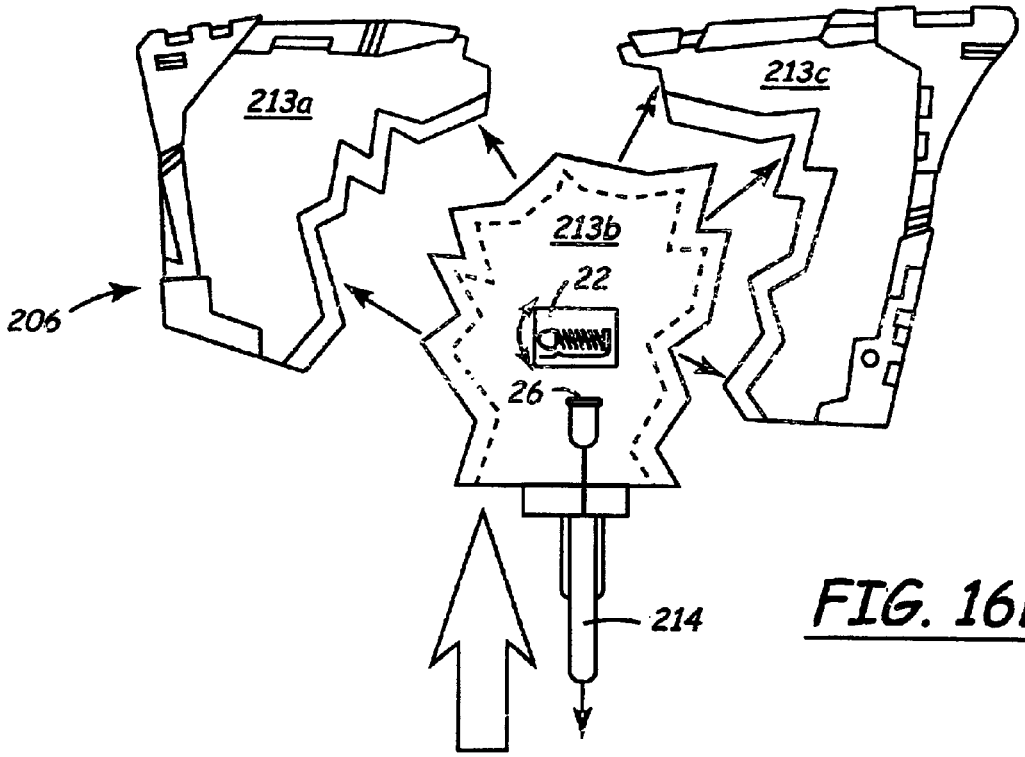

FIGS. 16*a* and 16*b* show the operation of the jump portion 202 as a vehicle 100 nears the end of the gauge 205 near the sign 206. In the embodiment shown, the elongated member 214 of the sign 206, as well as other portions of the sign 206, may be translucent such that light from the light source 26 passes through portions of the sign 206. As the vehicle 100 nears the end of the tube 205, the shake sensor 22 senses the presence of the vehicle 100 and causes the light source 26 to illuminate the tube of the gauge 205 as well as the sign 206, as shown in FIG. 16*a*. It the vehicle 100 reaches the end of the tube, the cam 216 of the tunnel runner 215 strikes the end of the elongated member 214, dislodging it from the gauge 205. The spring 20 then expels the sign 206, causing the breakaway pieces 213*a*, 213*b*, 213*c* to separate as shown in FIG. 16*b*. The shake sensor 22 continues to sense movement of the sign 206 and continues to illuminate the light source 26 as the sign 206 is expelled.

Figure 17:
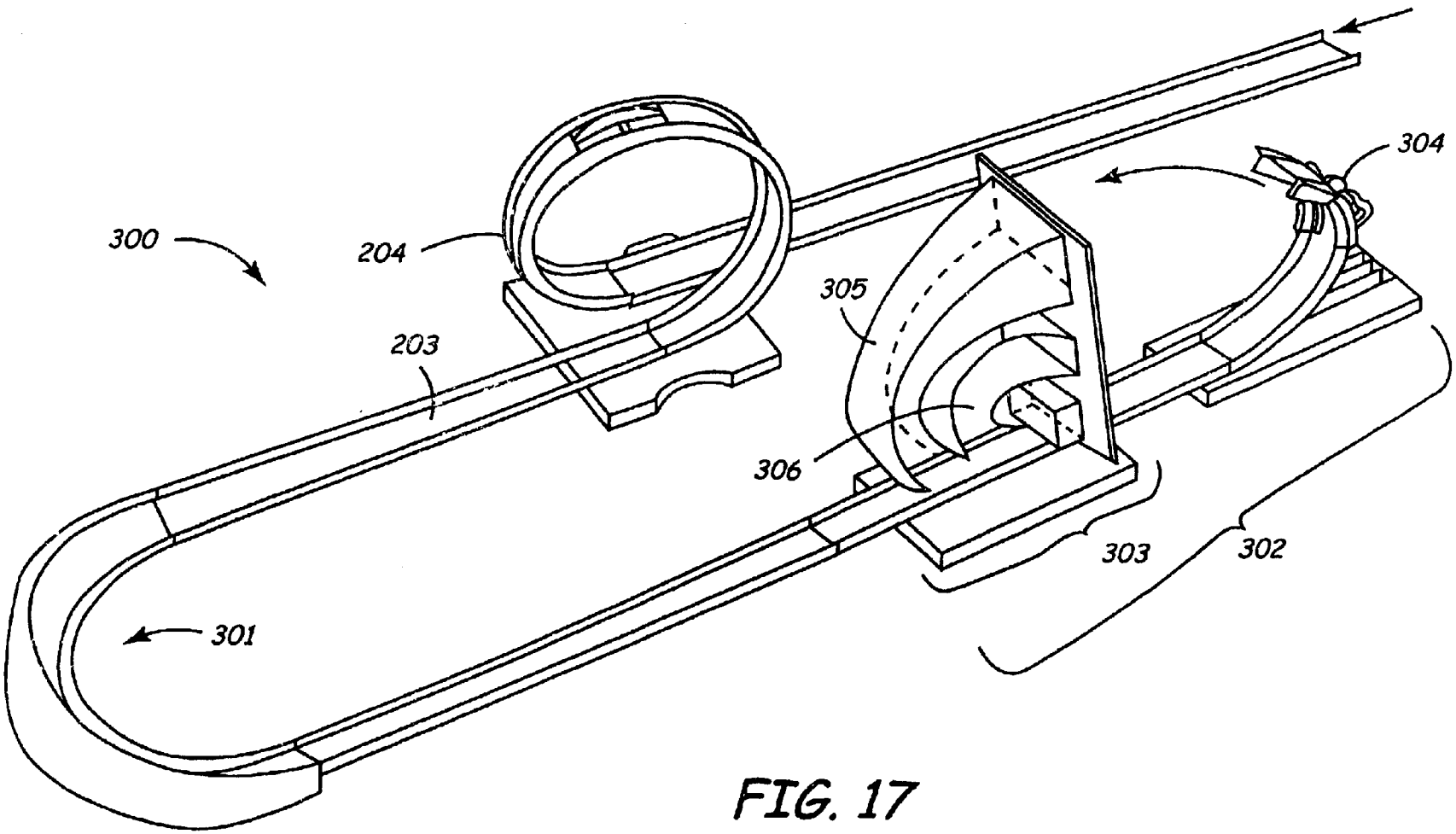
FIG. 17 shows another embodiment of the track system.

FIG. 17 shows another embodiment of the race track and car system 300 for use with a race car 100. The track system 300 includes segments of track 203, a loop 204 formed from the track 203, a 180-degree turn 301, and a jump-and-tunnel portion 302. The jump-and-tunnel portion 302 includes a jump 304 formed from the track 203 and a tunnel portion 303, including one or more tunnels 305, 306. In use, a vehicle 100 travels along the track 203, through the loop 204, around the 180-degree turn 301, and into the jump-and-tunnel portion 302 at the end of the track. The jump 304 is designed such that it redirects the vehicle 100 toward the direction from which it came down the track 203. The jump 304 sends the vehicle 100 through the air from the end of the jump 304 in an upside down position toward the tunnel portion 303. The vehicle in an upside down position enters one of the tunnels 305, 306 in the tunnel system. The tunnel 305, 306 catches the vehicle 100 and redirects it back toward the jump 304.

In one use, the tunnel portion 303 includes a plurality of tunnels 305, 306 that are somewhat concentric in that the tunnels have different lengths, and one curves within the curvature of the larger tunnel such that the path of a vehicle in a first tunnel 305 does not cross with a path of a vehicle in a second tunnel 306 while in the tunnels 305, 306. As a vehicle 100 travels toward the jump 304 for the first time, it has an initial speed. That initial speed may propel the vehicle 100 from the jump 304 to the outer-most tunnel 305. The outer-most tunnel 305 catches the vehicle 100, redirects it to the track 203, and toward the jump 304 so that the vehicle 100 approaches the jump for a second time, this time at a reduced speed. Due to the reduced speed on the second pass, the vehicle 100 is unable to reach the outer-most tunnel 305 as it had on the first jump. Instead, on the second pass the vehicle 100 exits the jump 304 toward an inner tunnel 306, having an opening that is lower than that of the outer-most tunnel. The inner tunnel 306 again redirects the vehicle 100 toward the track 203 as the outer-most tunnel 305 had done previously, and the vehicle 100 proceeds toward the jump 304 for a third time. This process repeats itself depending upon the number of tunnels used in the system 302 and the momentum of the vehicle 100. In the embodiment shown in FIG. 17, only two loops 305, 306 are provided, and on the third pass over the jump 304, the vehicle 100 lands in a vehicle catch (not shown). In one embodiment, the jump 304 includes a pitch adjuster at the end of the jump 304 that adjusts the height of a vehicle's jump.

Figure 18:
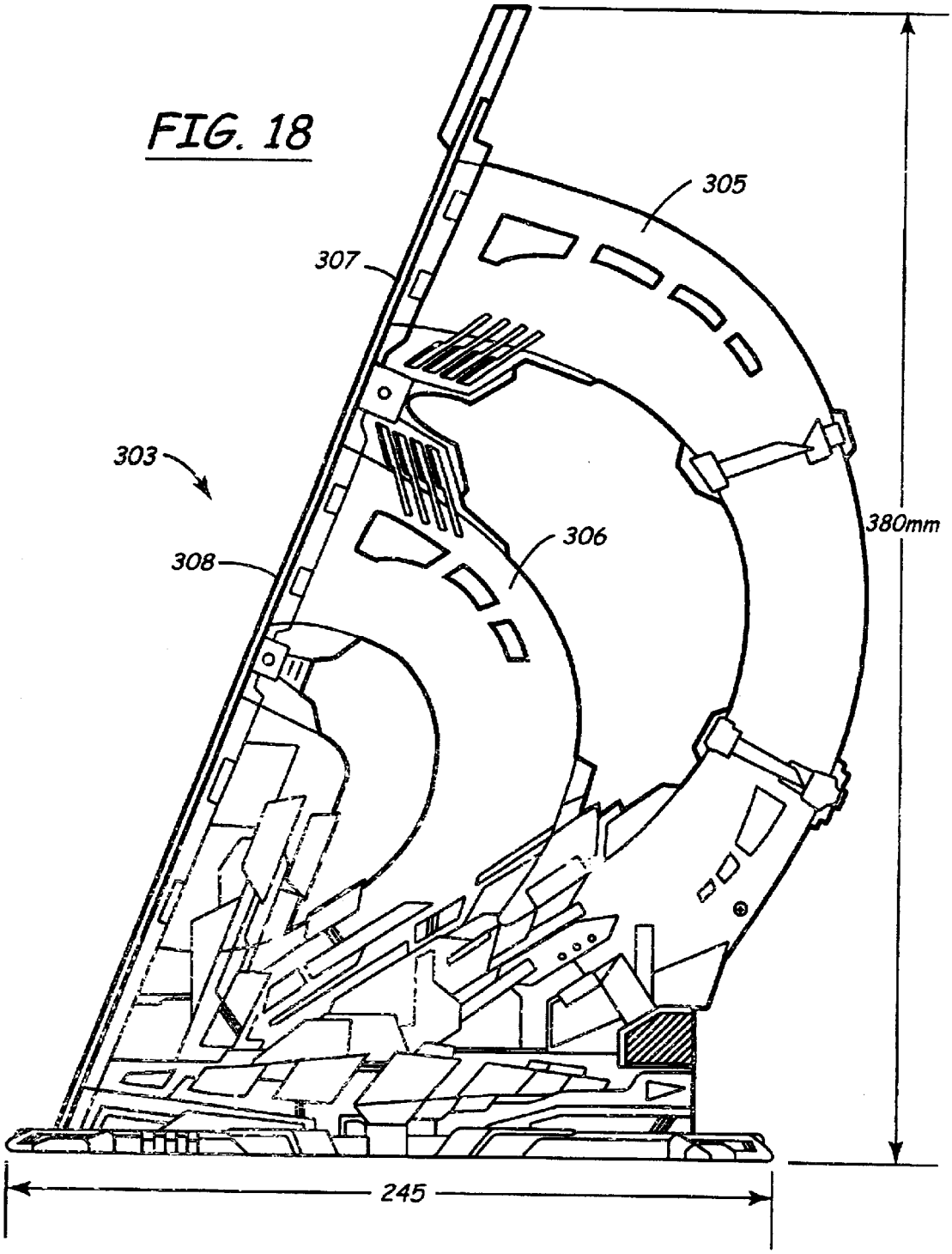
FIG. 18 shows the tunnel portion of the track system shown in FIG. 17.

FIG. 18 shows a more detailed diagram of the tunnel portion 303, including an outer loop 305 and an inner loop 306. The outer loop 305 is also referred to as "the loop" and has an opening 307 that receives a vehicle 100 from the jump 304. The inner loop 306 is also referred to as "the chute" and has an opening 308 for receiving the vehicle 100 from the jump 304.

Figure 19A:
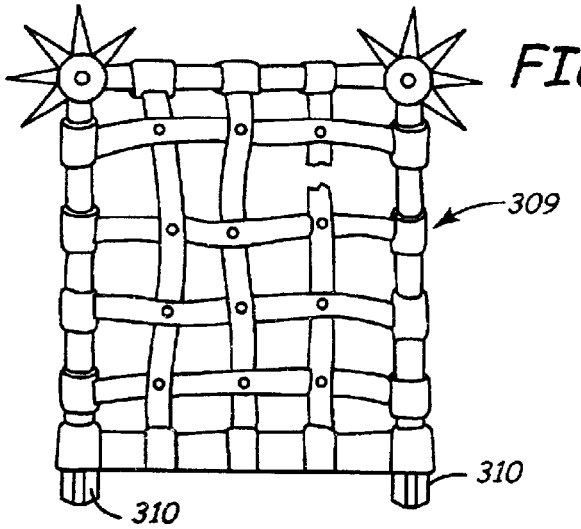
FIGS. 19*a–d* show the vehicle catch that may be used with the track system shown in FIG. 17.
Figure 19B:
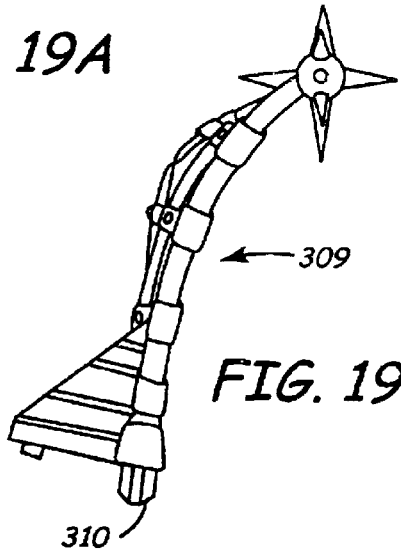
Figure 19C:
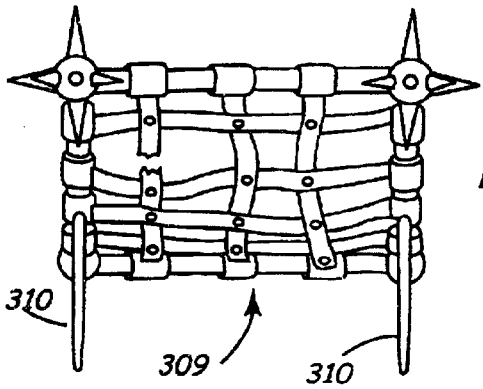
Figure 19D:
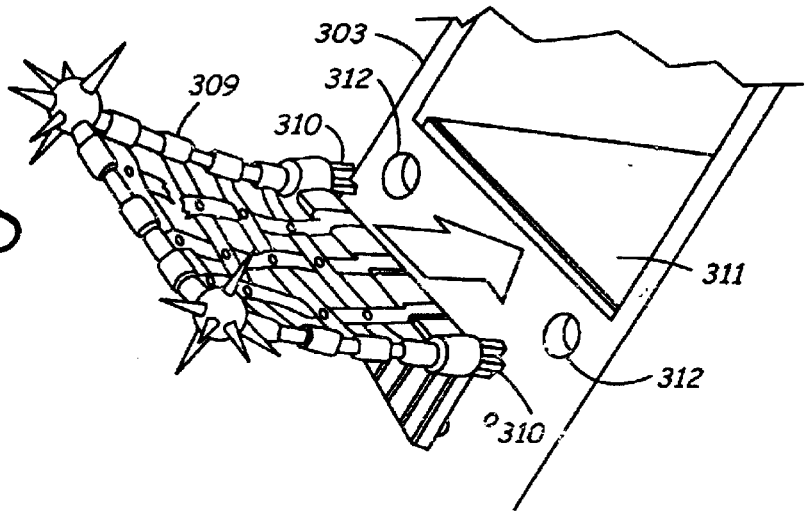

FIGS. 19*a* through 19*d* show a vehicle catch 309, used in one embodiment, that receives the vehicle 100 from the jump 304 when the vehicle 100 either misses one of the tunnel openings 307, 308 or does not have enough momentum to continue through the tunnels 305, 306. In the embodiment shown, the vehicle catch 309 includes a woven, basket design and includes connectors 310 for connecting to the tunnel portion 303. As shown in FIG. 19*d*, the tunnel portion 303 includes complementary connectors 312 for receiving the connectors 310 on the vehicle catch 309. As also shown in FIG. 19*b*, the vehicle catch 309 in this embodiment also includes an opening 311 in a front portion of the loop portion 303. The opening 311 facilitates the catching of the vehicle 100.

Figure 20:
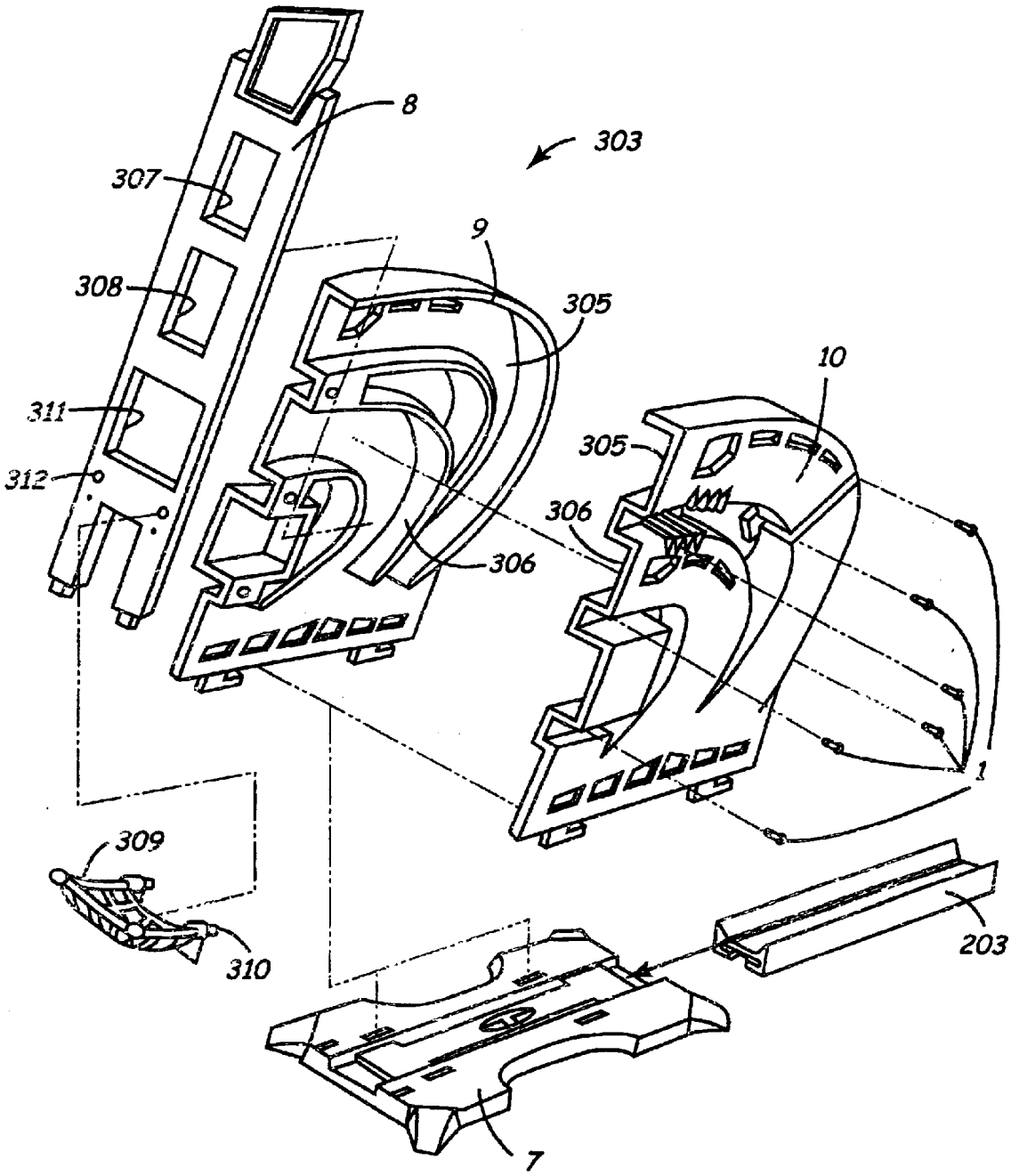
FIG. 20 shows an assembly view of the loop portion shown in FIG. 18.

FIG. 20 shows an assembly view of one embodiment of the tunnel portion 303. The tunnel portion 303 includes a front plate 8 having an outer loop opening 307, and inner loop opening 308, a vehicle catch opening 311, and connectors 312 for connecting a catch 309 to the front plate 8. In the embodiment shown in FIG. 20, the loop portion 303 includes two side portions 9, 10 that form the tunnels 305, 306. The side portions 9, 10 connect to the front plate 8 such that the openings 307, 308 correspond to the tunnels 305, 306 respectively. The front plate 8 and the sides 9, 10 mount to a tunnel base 7 that connects to a portion of track 203. Vehicles 100 passing through the tunnels are directed back toward this portion of track 203. The parts shown in the assembly of FIG. 20 may be held together, for example, by common screws 1.

Figure 21:
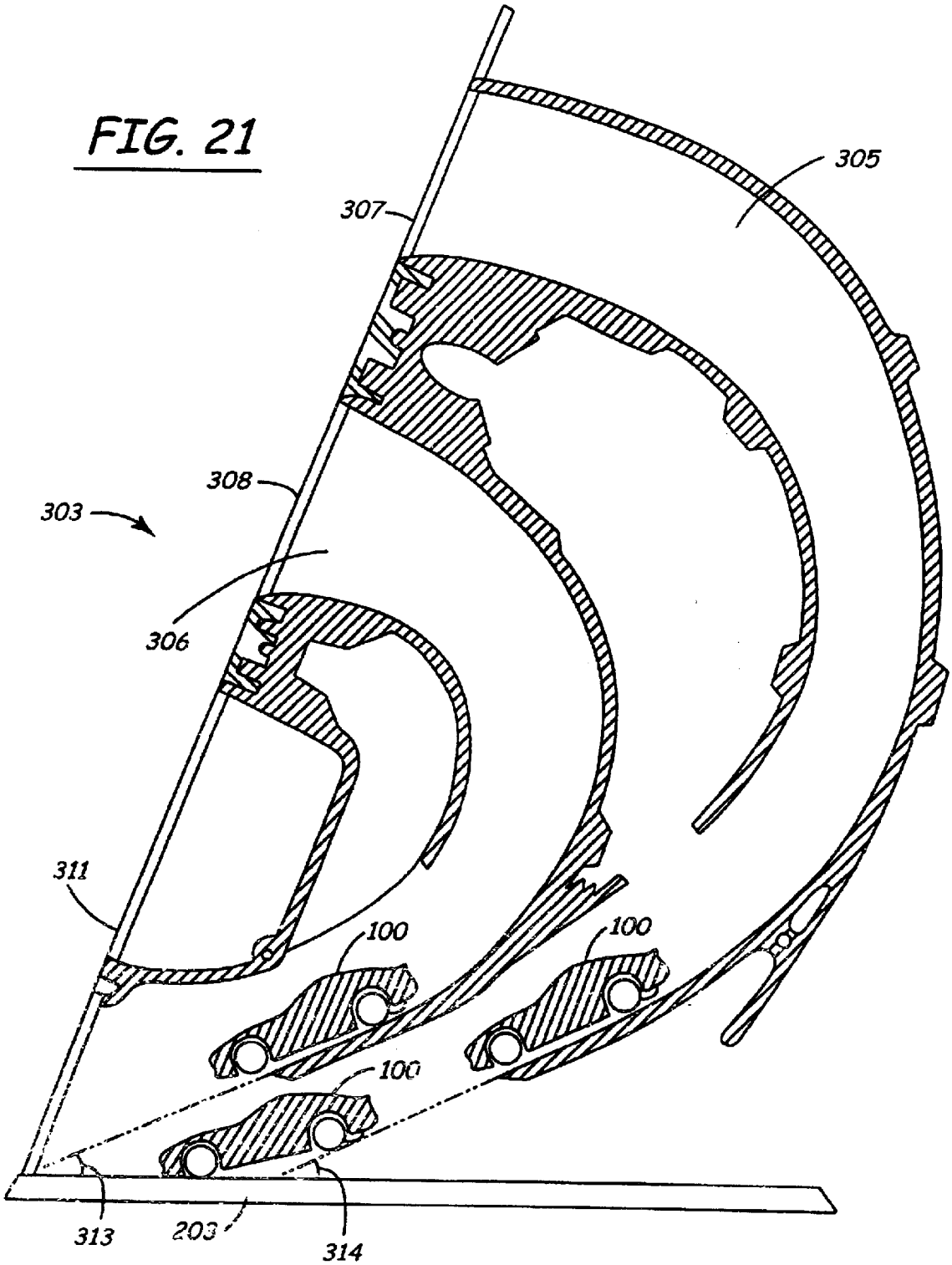
FIG. 21 shows another view of the loop portion shown in FIG. 18, in use with a vehicle.

FIG. 21 shows a view of the tunnel portion 303 showing a vehicle 100 passing through the tunnels 305, 306 at various positions. As shown, the openings 307, 308 of the tunnels 305, 306 are wider than other portions of the tunnels 305, 306 to facilitate catching the vehicle 100 as it flies through the air from the jump 304 and for directing it toward the track portion 203. As shown, the vehicles 100 are directed by the loops 305, 306 toward the track 203 at angles 313, 314 that enable the vehicles 100 to continue moving along the track 203 rather than crashing.

Figure 22:
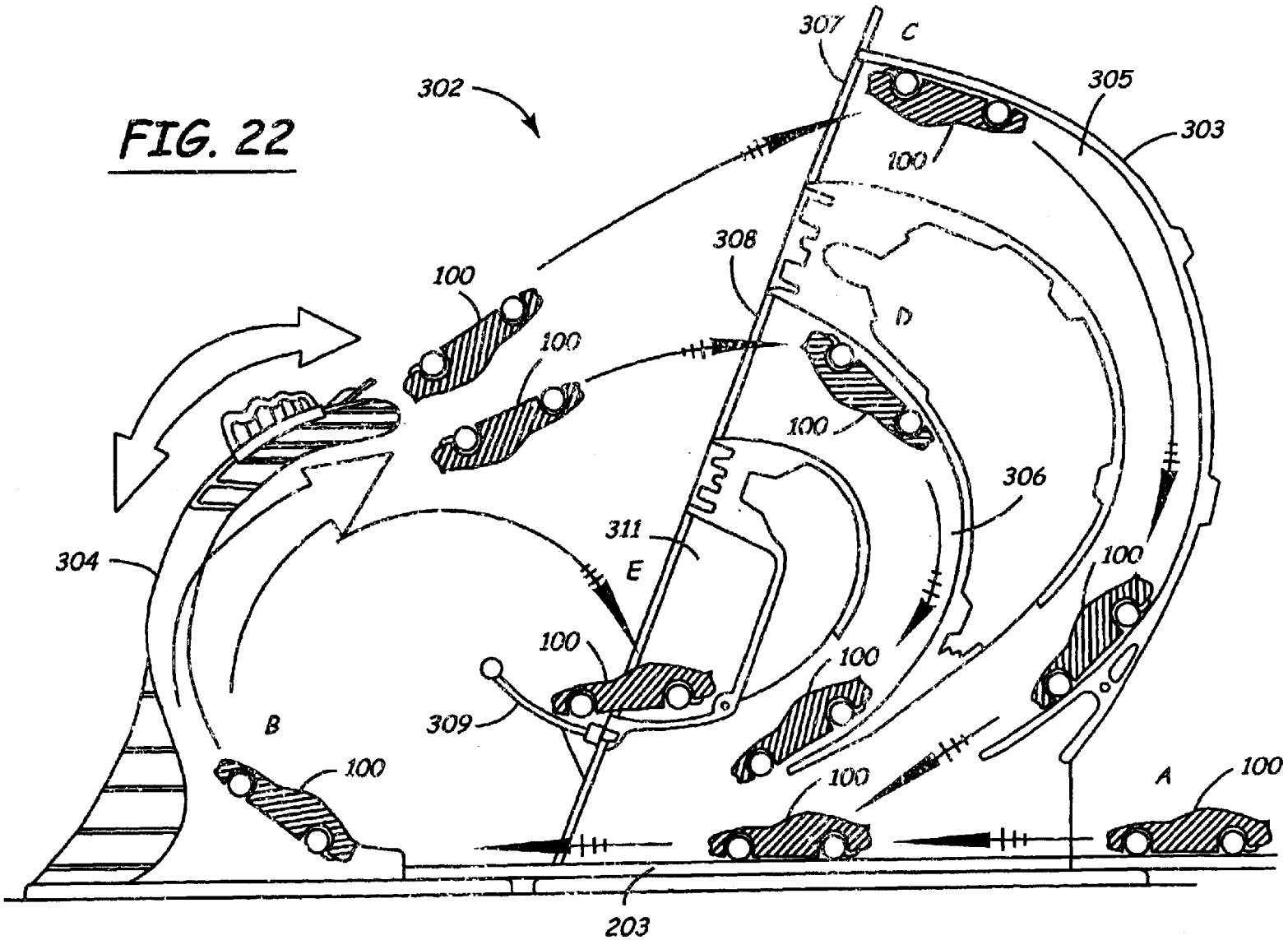
FIG. 22 shows a view of the loop-and-jump portions in use with a vehicle.

FIG. 22 shows another view of the jump-and-loop portion 302 in which a vehicle 100 is at various stages of the jump-and-loop portion 302, illustrated by the letters A through E. A vehicle 100 first enters the jump-and-loop portion 302 along the track 203, as indicated by the letter A. The track 203 directs the vehicle 100 toward the jump 304, as indicated by the letter B. The vehicle 100 proceeds up the jump 304 and toward the opening 307 of the outer loop 305 during the first pass through the jump-and-loop system 302, as indicated by the letter C. The vehicle 100 proceeds through the outer loop 305 and is redirected back toward the track 203 in a direction back toward the jump 304 for a second time. The second time over the jump 304, the vehicle 100 proceeds toward the opening 308 of the inner loop 306 due to its decreased speed and momentum, as indicated by the letter D. The inner loop 306 directs the vehicle again toward the track 203 in the direction of the jump. The third time over the jump 304, the vehicle 100 does not have sufficient momentum or speed to reach either the inner or outer loops 305, 306 and instead is received in the catch 309, as indicated by the letter E.

Figure 23B:
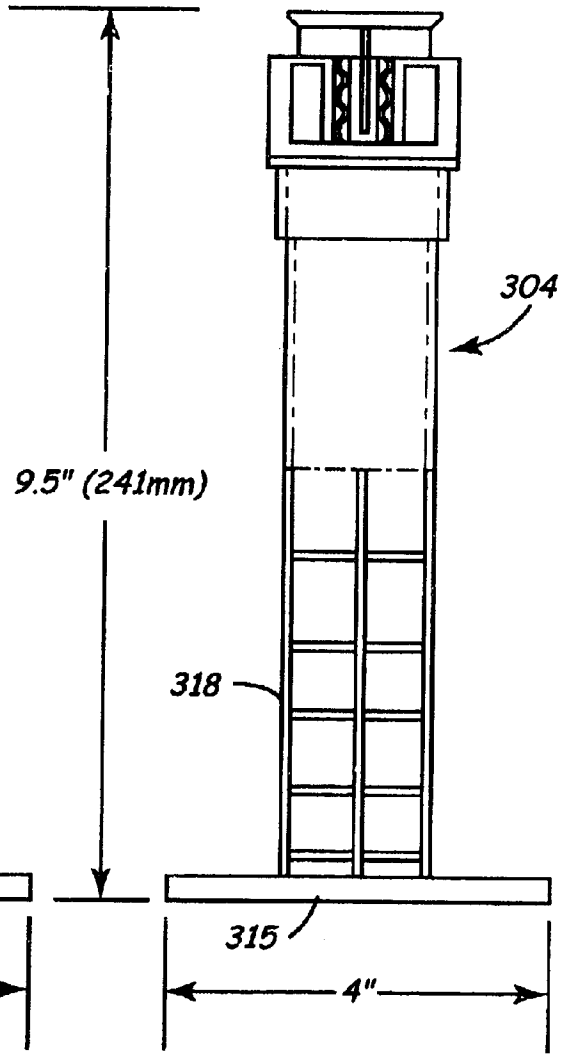
FIGS. 23*a–b* show more detailed views of the jump portion.
Figure 23A:
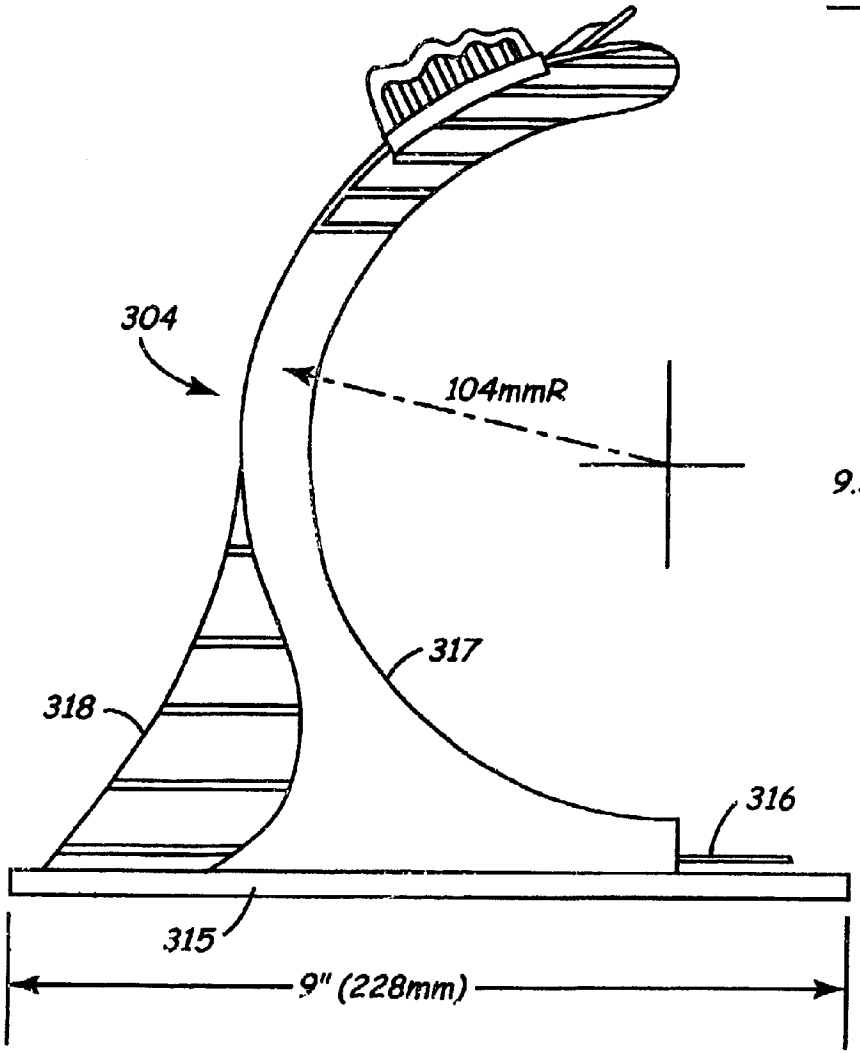

FIGS. 23*a* and 23*b* show a more detailed diagram of the jump 304 shown in FIG. 22. The jump 304 includes a base 315, a vehicle surface 317 on which vehicles travel, a track connector portion 316 that engages a piece of track 203, and a support structure 318.

Figure 24B:
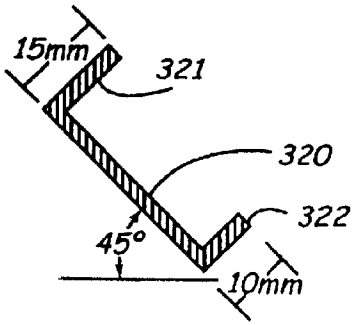
FIGS. 24*a–c* show more detailed views of the 180-degree turn shown in FIG. 17.
Figure 24C:
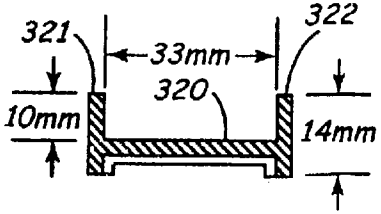
Figure 24A:
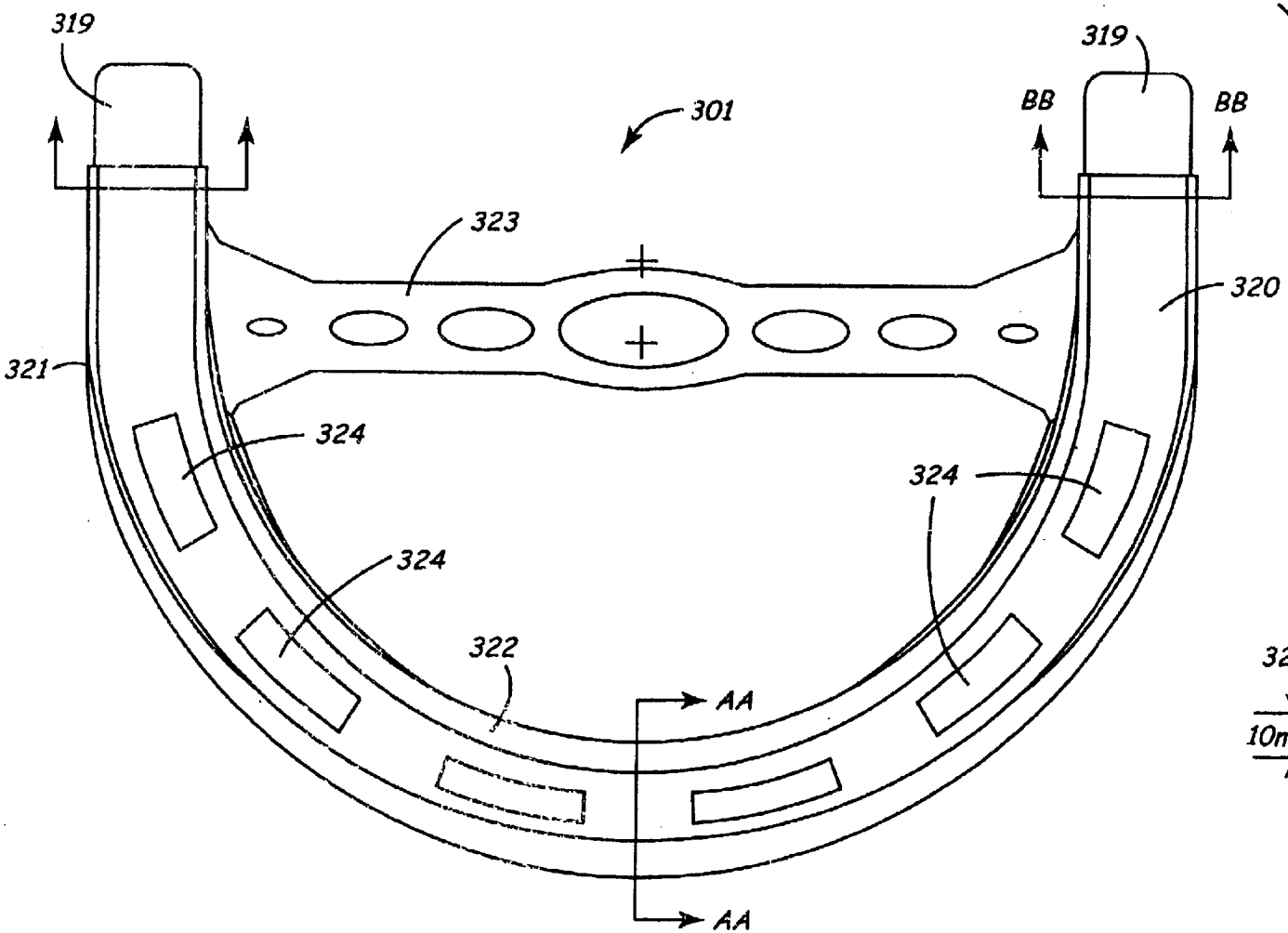

FIGS. 24*a* through 24*c* show more detailed diagrams of the 180-degree turn 301 shown in FIG. 17. The turn 301 connects to portions of track 203 by connectors 319. Vehicles 100 are directed from a track 203 to the track surface 320 of the turn 301. Turn 301 has sidewalls 321, 322. FIGS. 24*b* and 24*c* are cross-sections of the track shown in FIG. 24*a* taken along the lines AA—AA and BB—BB, respectively. As shown in FIG. 24*b*, the inner sidewall 322 is shorter than the outer sidewall 321 near the center of the turn 301. Near the beginning and end of the turn 301, the sidewalls are substantially equal in height as shown in FIG. 24*c*. The turn 301 includes a support brace 323 that connects the beginning and end of the turn 301. The turn 301 also includes lighted portions 324 on the track 320. In one embodiment, the lighted portions 324 illuminate when a vehicle 100 passes over the lighted portions 324 or near the lighted portions 324, for example, to indicate an approaching vehicle 100 such that the light path is created in front of the vehicle 100 as the vehicle 100 negotiates the turn 301.

Figure 25:
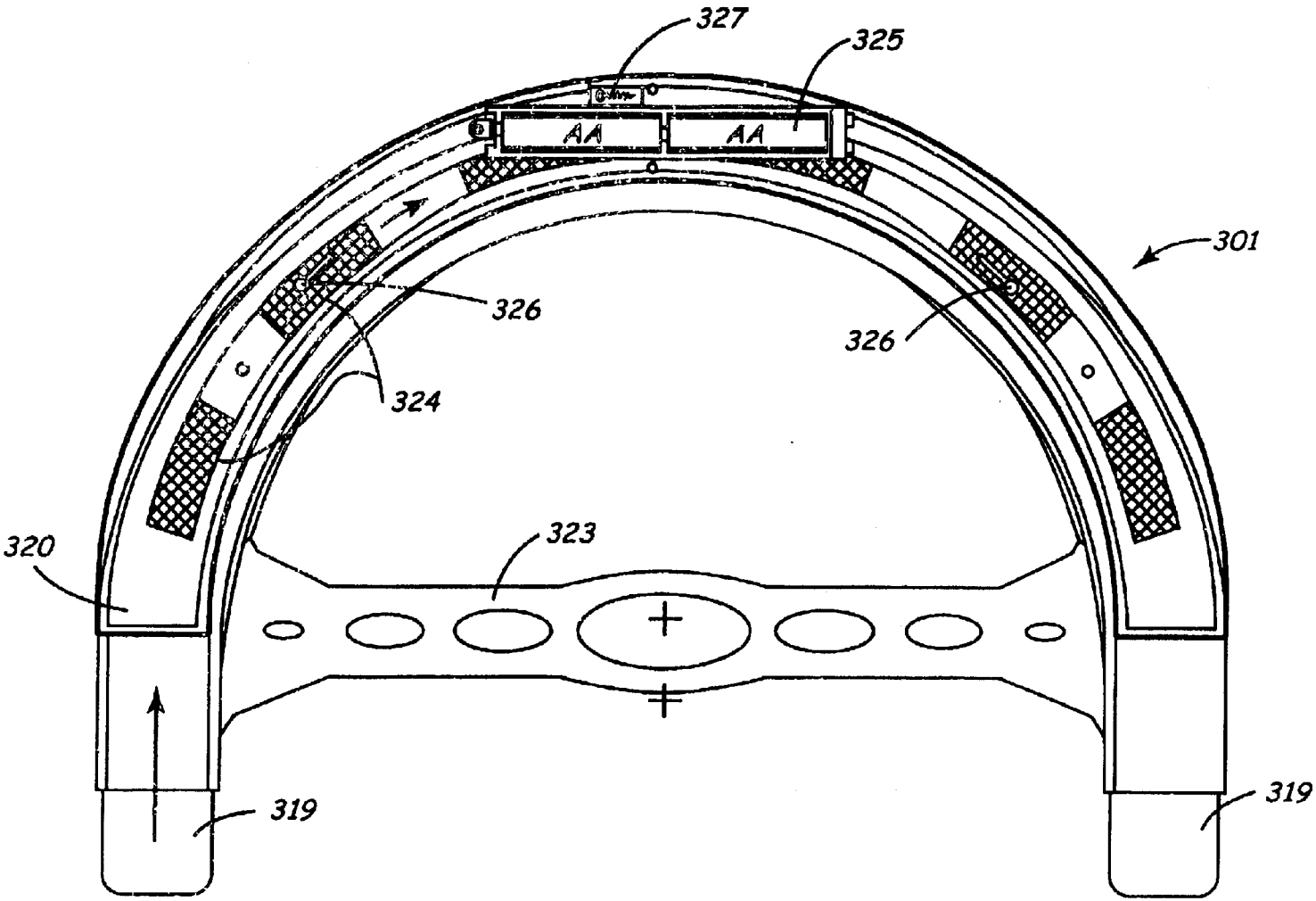
FIG. 25 shows a more detailed view of the 180-degree turn shown in FIG. 24*a*.

FIG. 25 shows a more detailed diagram of the 180-degree turn 301 shown in FIG. 24. The embodiment shown in FIG. 25, the track portion 320 of the 180-degree turn 301 includes lighted portions 324. The lighted portions 324 are lit by a light source 326. The light source 326 may be located in each lighted portion 324, or light from a single source 326 may be used to illuminate adjacent lighted portions 324. A power source 325 such as a battery 325 is used to power the light source 326. A shake sensor 327 connects the power source 325 to the light source 326. The shake sensor 327 is positioned to detect the presence of a vehicle 100 on the vehicle surface 320 of the turn 301 and causes the light sources 326 to illuminate upon detecting such movement. In one embodiment, the light source 326 and shake sensor 327 are configured such that the light source 326 flickers as the shake sensor 327 vibrates due to a vehicle 100 traveling on the surface 320 of the turn 301, or another portion of the track 203.

Figure 26:
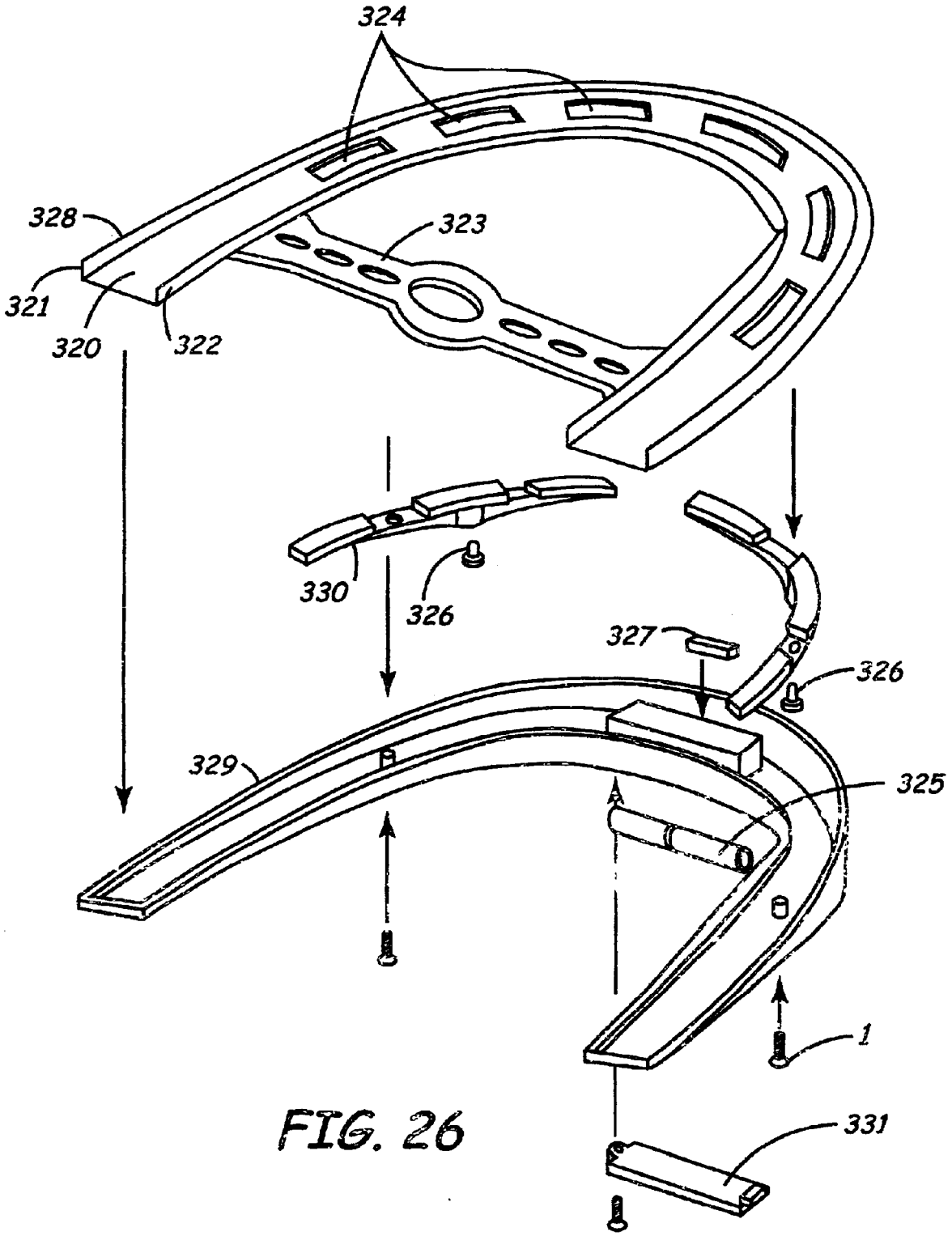
FIG. 26 shows an assembly view of the 180-degree turn shown in FIGS. 24*a* and 25.

FIG. 26 shows an assembly view of the 180-degree turn 320. The turn 301 includes a top portion 328 having a track surface 320 and sidewalls 321, 322. A support 323 is also part of the top portion 328, as are the lighted portions 324, which may be openings or clear portions in the track surface 320. The bottom portion 329 of the turn 301 connects to the top portion 328 using conventional screws 1, for example. In the embodiment shown in FIG. 26, light sources 326 are connected to insert plates 330 that enable a single light source 326 to illuminate multiple lighted portions 324. The insert plate 330 is translucent and has portions adapted for engaging the lighted portions 324 or openings 324 of the top portion 328 of the turn 301. The light sources 326, the insert plates 330, the shake sensor 327, and the power source 325 may all be part of the bottom portion 329 of the turn 301 or may be positioned between the bottom portion 329 and the top portion 328. A battery cover 331 may also be used to cover batteries 325 in a battery-operated system.

Figure 27:
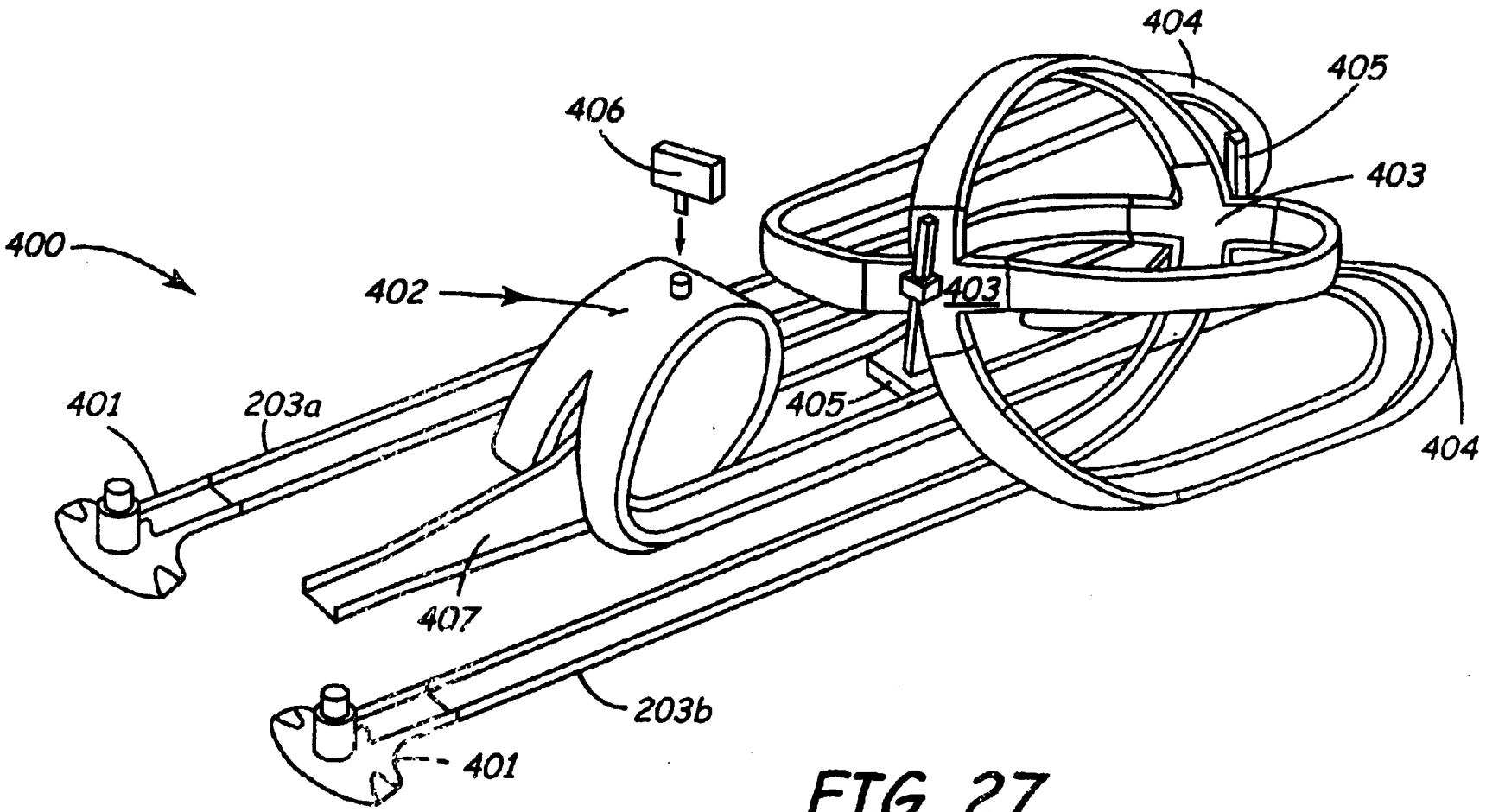
FIG. 27 shows another embodiment of the track system.

FIG. 27 shows another embodiment of a track system 400 adapted for use by two vehicles 100 at the same time. Track system 400 includes two substantially similar tracks 203*a*, 203*b* that connect in a funnel portion 407 after passing through a series of intersections, turns, and curves. Vehicles 100 may be started on the tracks 203*a*, 203*b* at the same time so that their paths cross at criss-cross intersections 403 at which the vehicles 100 may strike each other if they reach the intersections 403 at the same time. Track system 400 can also be used to race vehicles on adjacent tracks 203*a*, 203*b* using the funnel portion 407 that allows only one of the vehicles to exit the track system 400 first. In one embodiment, the vehicles 100 are started using starters 401 connected to the beginning portions of the respective tracks 203*a*, 203*b*. Vehicles 100 on adjacent paths travel along paths that are more or less mirror images of each other. In the embodiment shown in FIG. 27, the vehicles 100 first enter a first intersection 403, continue traveling through their respective loops toward a second intersection 403, and each vehicle 100 then enters its own 180-degree turn 404. From the turn, each of the vehicles enters a criss-cross loop 402 that causes the vehicles' paths to cross while inside the loop 402 and funnels the vehicles 100 to the funnel portion 407 that allows only one of the vehicles 100 to exit the track system 400 first. The criss-cross loop 402 includes a sign 406 mounted on top of the loop 402.

Figure 28:
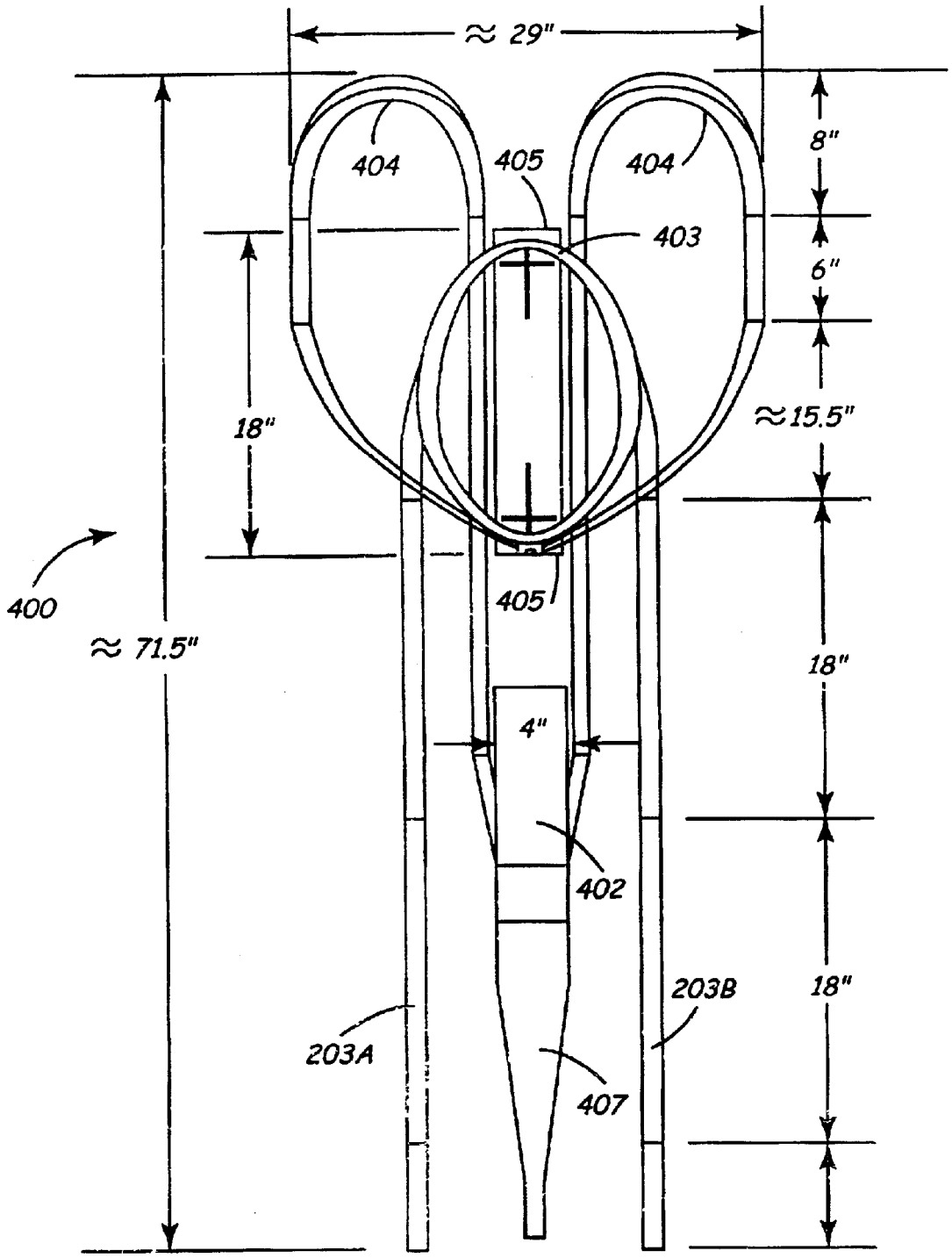
FIG. 28 shows a top view of the track system shown in FIG. 27.

FIG. 28 shows a top view of the track system 400 shown in FIG. 27. As shown in FIG. 28, the paths defined by the adjacent tracks 203*a*, 203*b* are more or less mirror images of each other. Each track 203*a*, 203*b* directs vehicles 100 through intersections 403 connected by loops, which in turn direct the vehicles 100 toward 180-degree turns 404 and then back toward a criss-cross loop 402. The criss-cross loop 402 sends the vehicles 100 to a funnel portion 407 that allows only one of the vehicles 100 to exit first.

Figure 29:
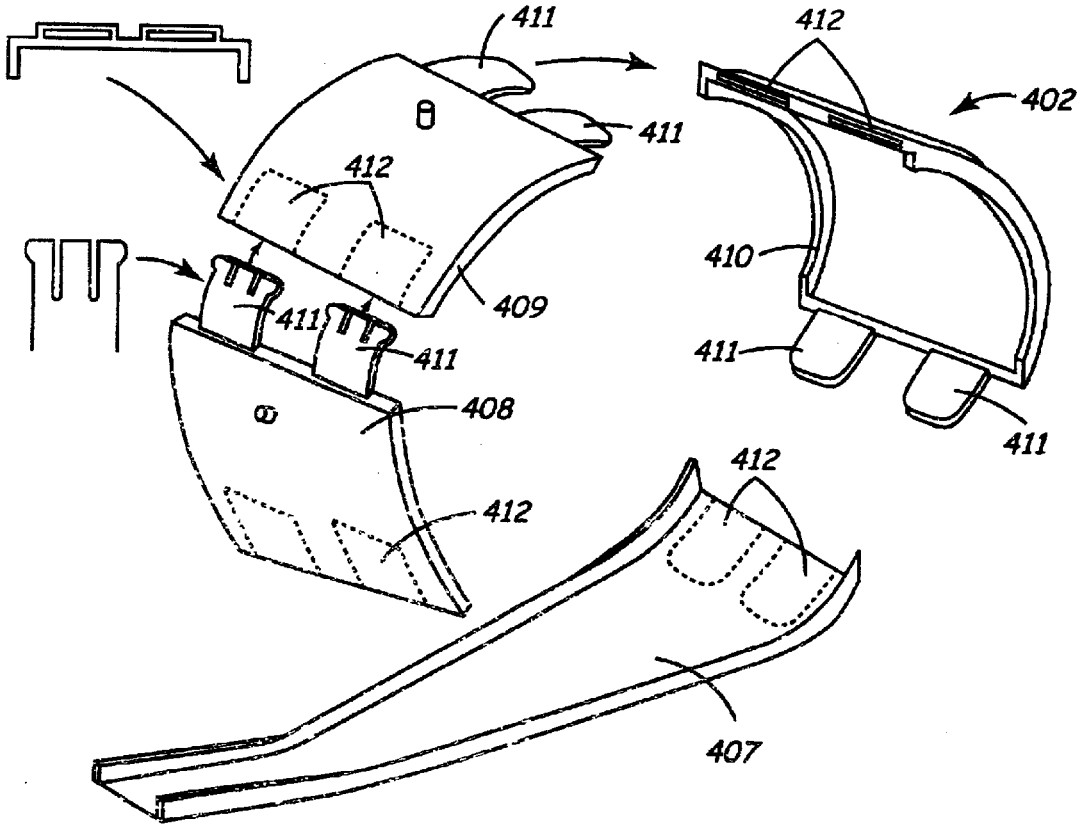
FIG. 29 shows a more detailed view of the criss-cross loop shown in FIGS. 27 and 28.

FIG. 29 shows a more detailed diagram of the criss-cross loop 402 shown in FIG. 27. The loop 402 includes three curved, two-lane portions 408, 409, 410. In one embodiment, each of these portions 408, 409, 410 is substantially similar and has a width of approximately 2½ times the width of the respective tracks 203*a*, 203*b*. The width of the loop portions 408, 409, 410 allows two vehicles 100 to be side-by-side in the loop 402 at the same time, without leaving the surface of the loop 402. The loop portions, 408, 409, 410 connect using complementary male and female connectors 411 and 412. The third loop portion 410 connects to a funnel portion 407, also using the connectors 411, 412. The funnel portion 407 reduces the width of the track available to the vehicles 100 from 2½ times the width of the single-lane tracks 203*a*, 203*b* to a single-lane width. This funnel 407 enables two vehicles 100 to be side-by-side at the entrance to the funnel portion 407 but directs the vehicles 100 to a single lane, whereby only one of the vehicles 100 exits the track system 400 first.

Figure 30:
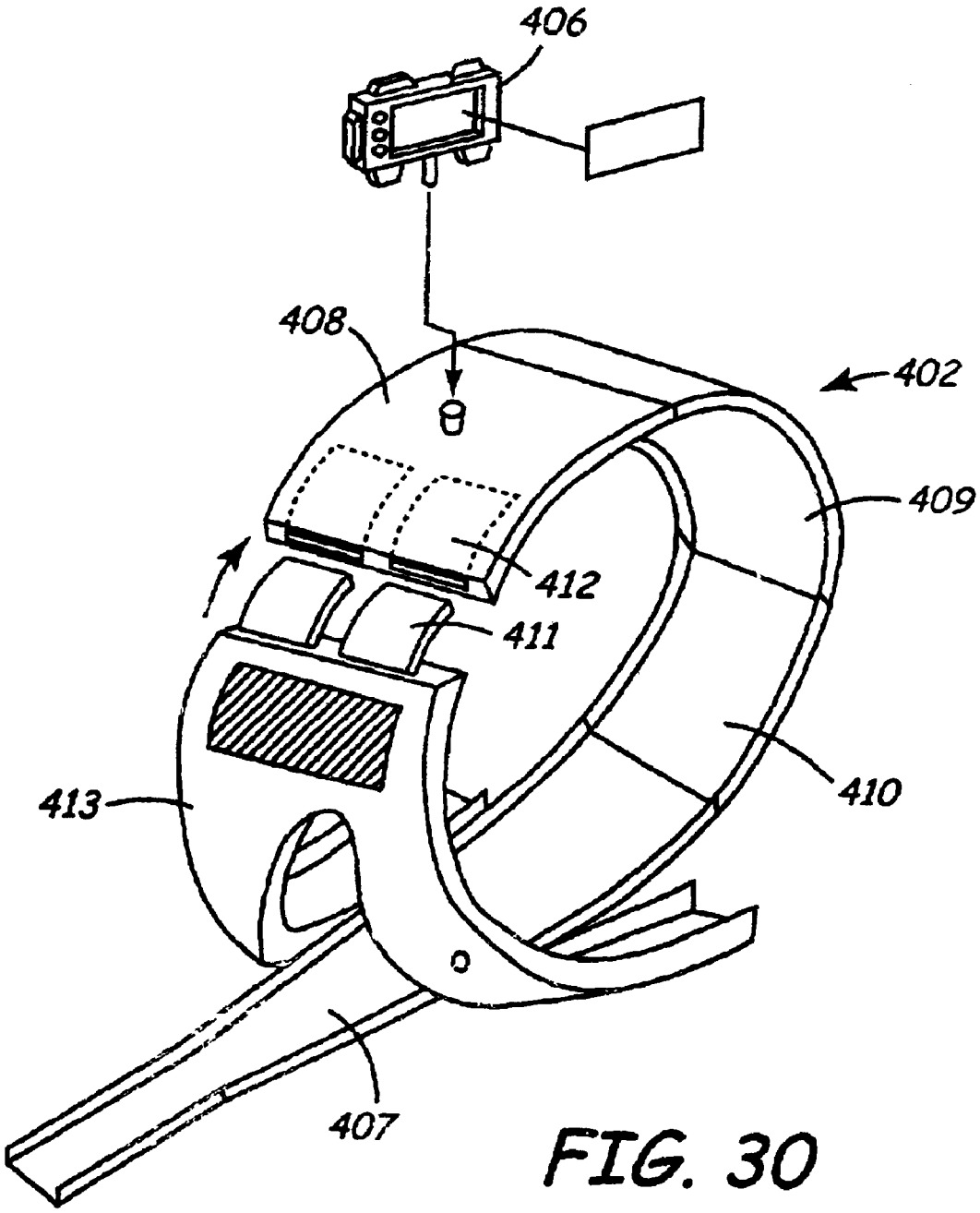
FIG. 30 shows another view of the criss-cross loop shown in FIG. 29.

FIG. 30 shows an assembled loop 402 having the three loop portions 408, 409, 410 connected, with the third loop portion 410 connected to the track funnel 407. As with other track connections, the loop portions 408, 409, 410 and the track funnel 407 are connected such that the driving surface is substantially smooth from one track portion 408, 409, 410 to another. FIG. 30 also shows the fork portion 413 of the loop 402. The fork portion 413 receives vehicles 100 on two separate single-lane portions and directs the vehicles 100 to a wider portion of the track that comprises the loop 402. The fork portion 413 connects to the first loop portion 408 using the connectors 411, 412 described herein. Also shown in FIG. 30 is the sign 406 that connects to one of the loop portions 408, 409, 410.

Figure 31A:
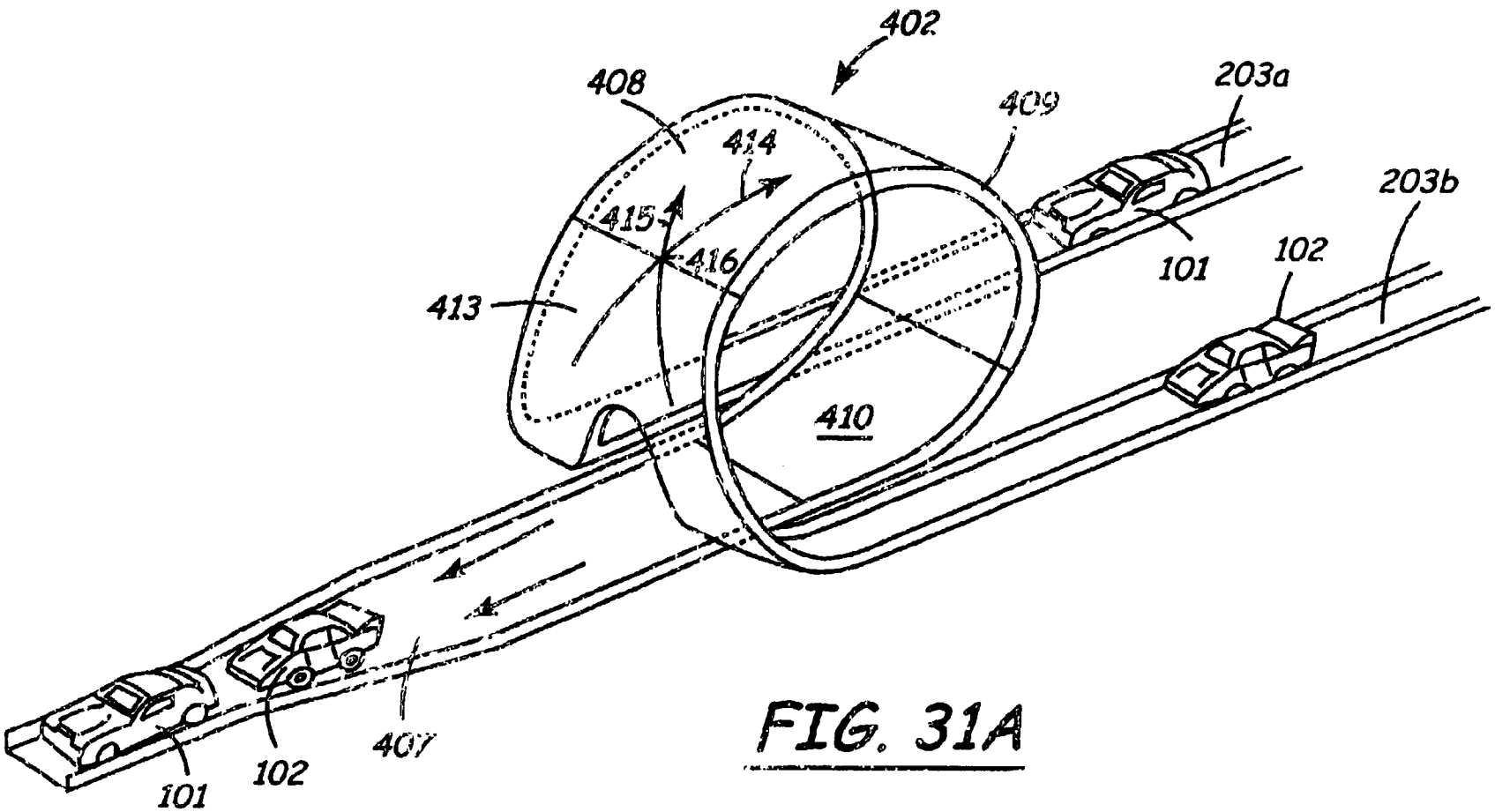
FIGS. 31*a–b* show more detailed views of the criss-cross loop in use with vehicles.
Figure 31B:
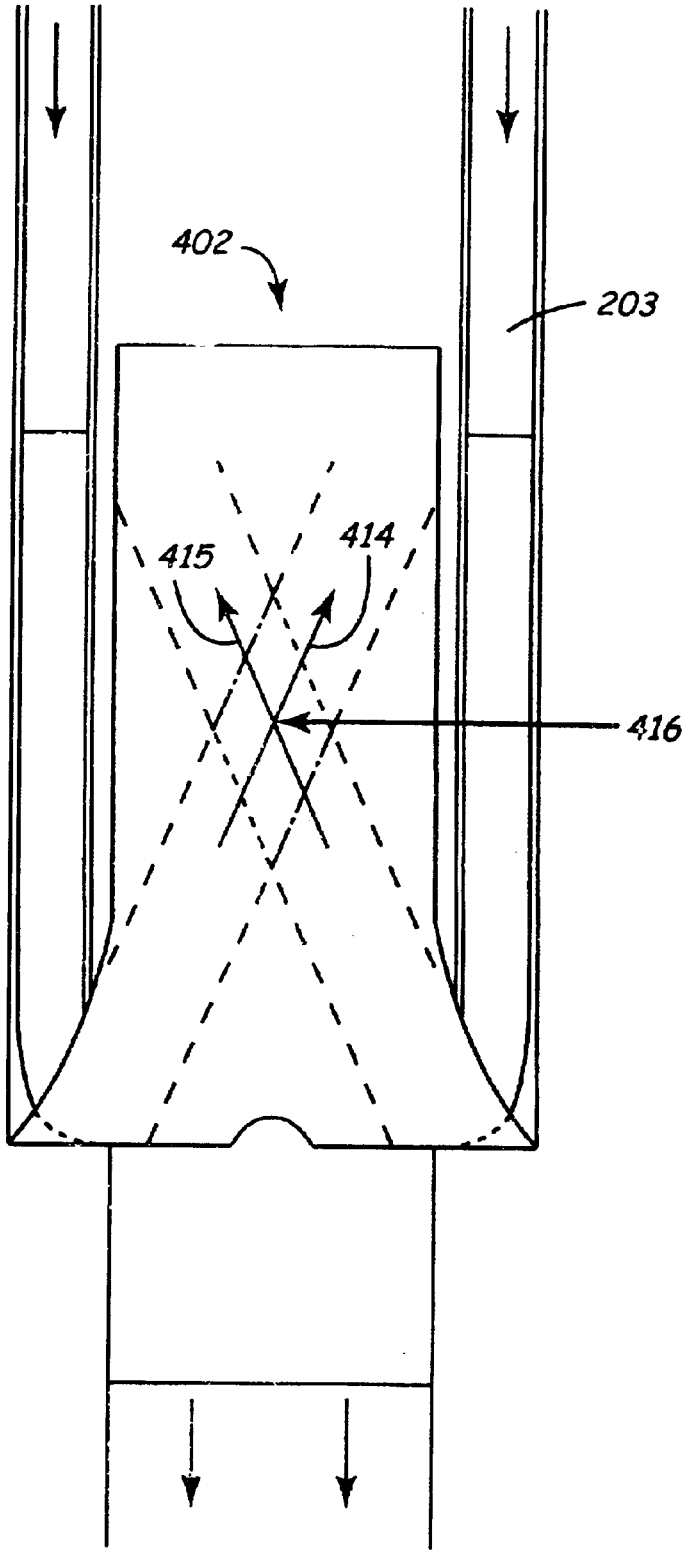

FIGS. 31*a* and 31*b* illustrate the paths taken by two vehicles 101, 102 used on the track system 400 at the same time. The first vehicle 101 proceeds down the first track 203*a* toward the loop 402 at approximately the same time as a second vehicle 102 proceeds down a second track 203*b*, also toward the loop 402. The fork portion 413 directs the two vehicles 101, 102 toward each other in the loop while upside down. The first vehicle 101 takes a first path 414 toward the path 415 taken by the second vehicle. The vehicles' paths 414, 415 cross at an intersection point 416 that may be located at a position at which the vehicles 101, 102 are vertical or upside down within the loop 402. If the vehicles 101, 102 reach the intersection point 416 at the same time, they will crash and may not complete the race. If the vehicles 101, 102 continue past the intersection point 416, they will continue through the loop 402 toward the funnel portion 407 which will determine a winner because only one of the vehicles 101, 102 can reach the end of the track first. In one embodiment, the loop 402 is made of transparent or translucent material so that a user can view the paths of the vehicles 101, 102 as they proceed through the loop 402 and in particular so that the user can see the vehicles 101, 102 crash if they reach the point of intersection 416 at the same time. FIG. 31*b* further illustrates the intersection 416 of the paths 414, 415 taken by the respective vehicles 101, 102. FIG. 31*b* is a top view of the loop 402 indicating that the vehicles' paths 414, 415 may intersect near the top portion of the loop 402.

Figure 32:
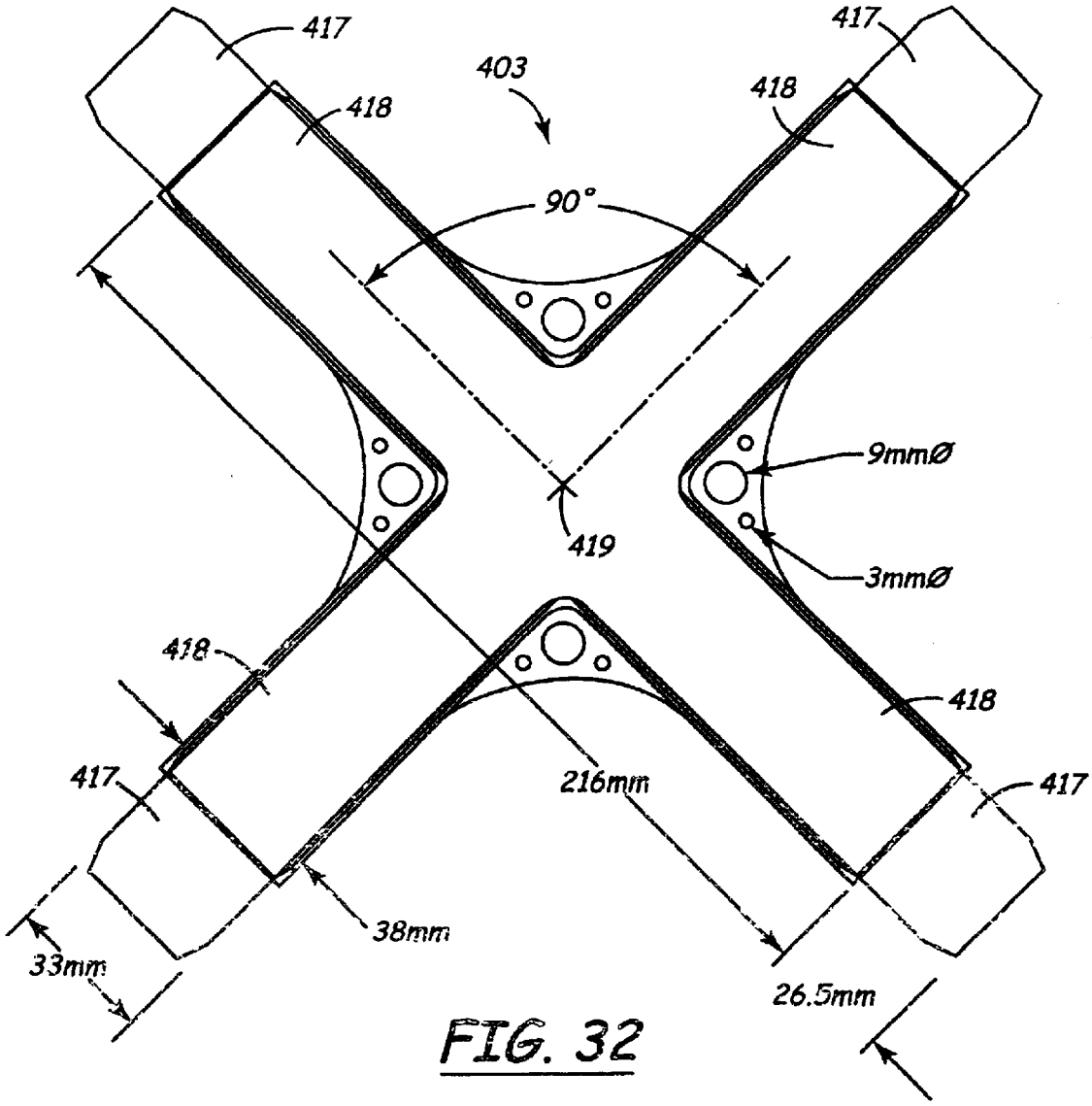
FIG. 32 shows a more detailed view of the intersections shown in FIG. 27.

FIG. 32 shows a more detailed diagram of the intersections 402 shown in FIG. 27. The intersection 403 receives separate vehicles 101, 102 from two substantially perpendicular directions and directs those vehicles 101, 102 straight forward to another portion of the track system 400. Vehicles 101, 102 may crash at a point of intersection 419 at or near the center of the intersection portion 403. The intersection portion 403 includes the track portion 418 on which the vehicles 101, 102 travel. The intersection 403 also includes connector portions 417 for engaging other track sections 203. As shown in FIG. 27, the intersection portion 403 may be held in place by support stands 405 such that the center point 419 of the intersection 403 is substantially vertical, and such that the vehicles 101, 102 may crash while each vehicle 101, 102 is in a substantially vertical position.

Figure 33:
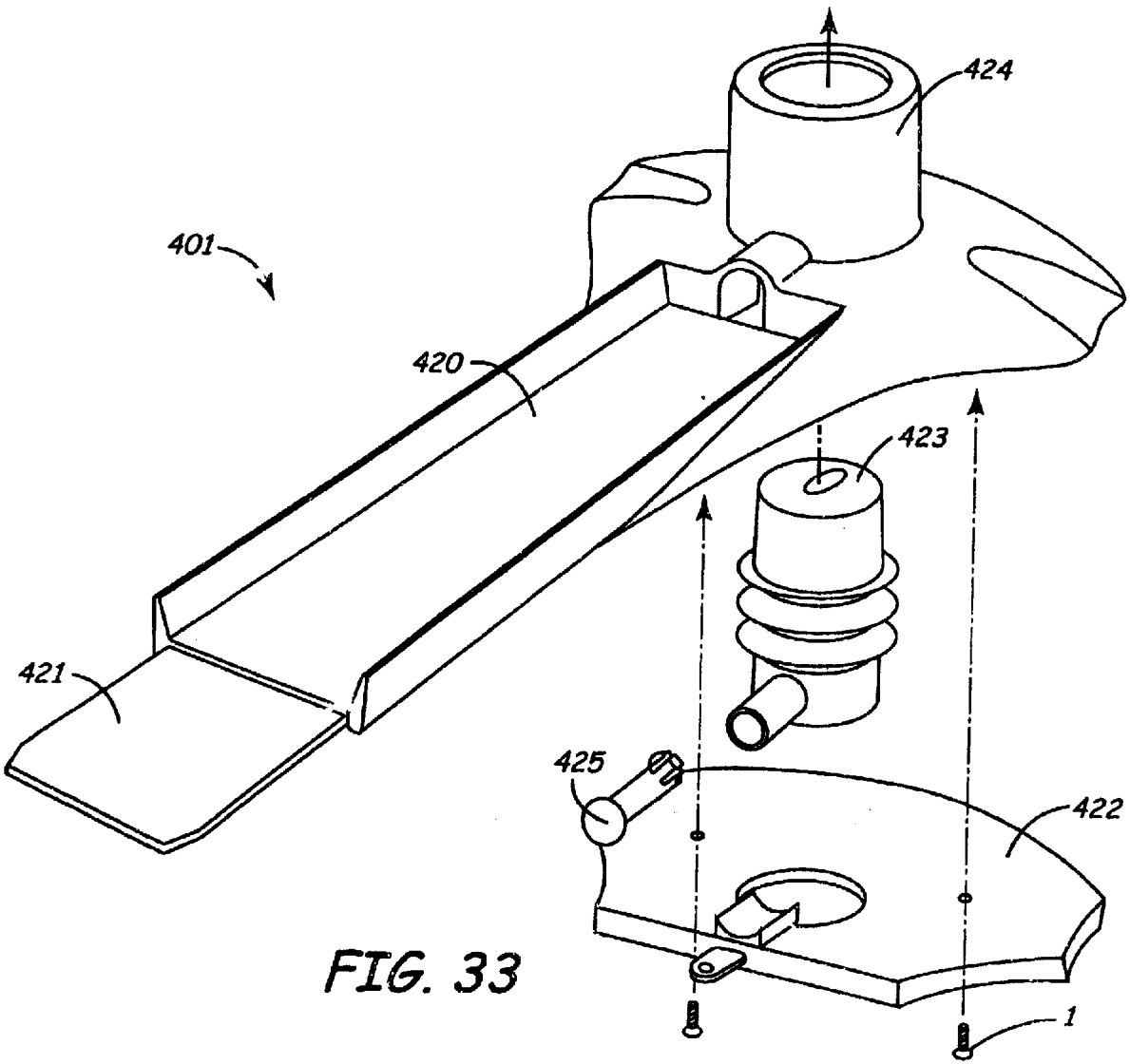
FIG. 33 shows a more detailed view of the start gate shown in FIG. 27.

FIG. 33 shows a more detailed diagram of the start gate 401 shown in FIG. 27. The start gate 401 may be used to propel vehicles down the respective track portions 203*a*, 203*b* as shown in FIG. 27. Start gate 401 includes a start chute 420 that holds the vehicle 100 before it leaves the gate 401. The chute 420 has a vehicle surface that is substantially flush with a track portion 203*a*, 203*b* and connected thereto using a track connector 421, which may be molded as part of the start gate 401. The start chute 420 connects to a start gate base 422 in the embodiment shown in FIG. 33. Vehicles 101, 102 are propelled from the start gate 401 by a bellows 423 or other air supply 423. The bellows 423 is compressed by a user and drives a piston 425 forward toward the vehicle 101, 102. The bellows 423 and piston 425 reside within a housing 424 of the start gate 401. In the embodiment shown in FIG. 33, the parts of the start gate 401 are held together by conventional screws 1.

Figure 34A:
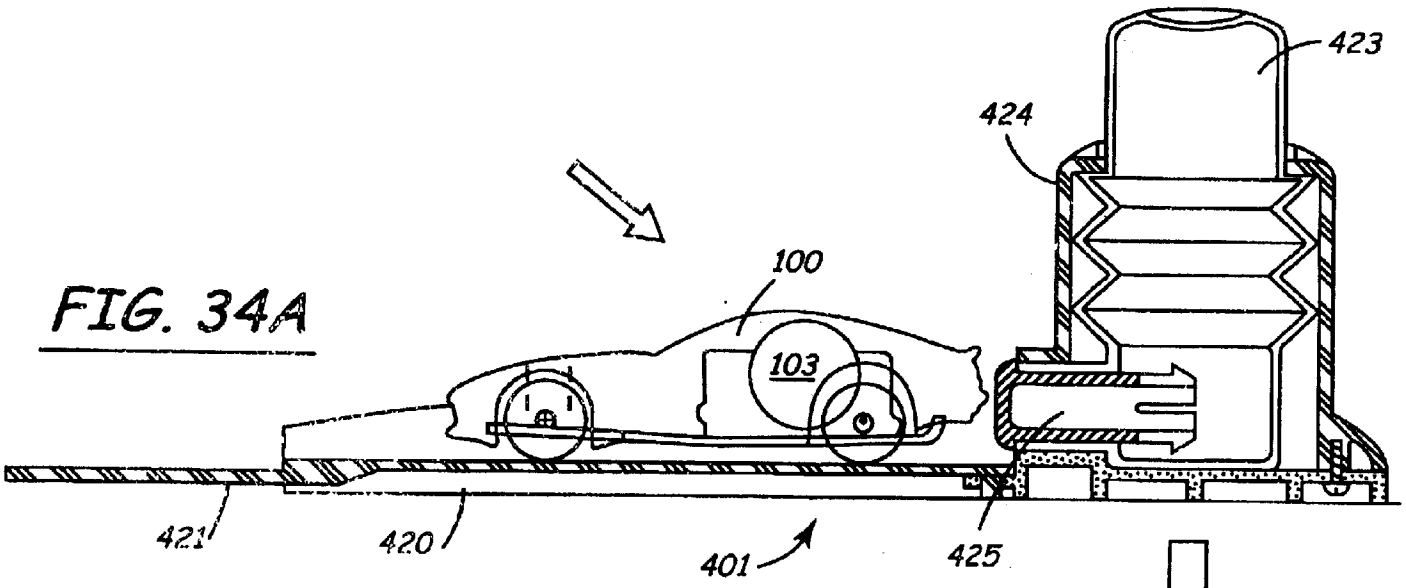
FIGS. 34*a–b* show more detailed diagrams of the start gate shown in FIG. 33, in use with vehicles.
Figure 34B:
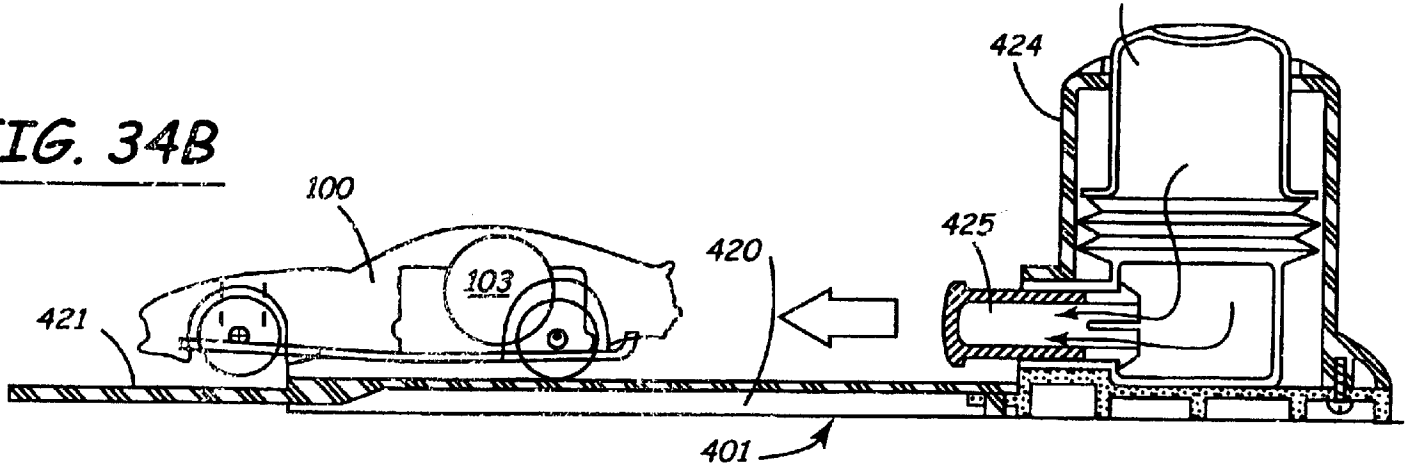
Figure 35A:
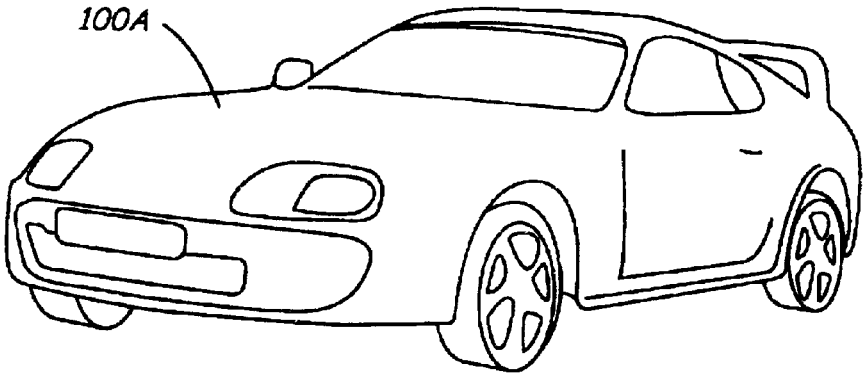
FIGS. 35*a–d* show body styles that may be used on the vehicles.
Figure 35B:
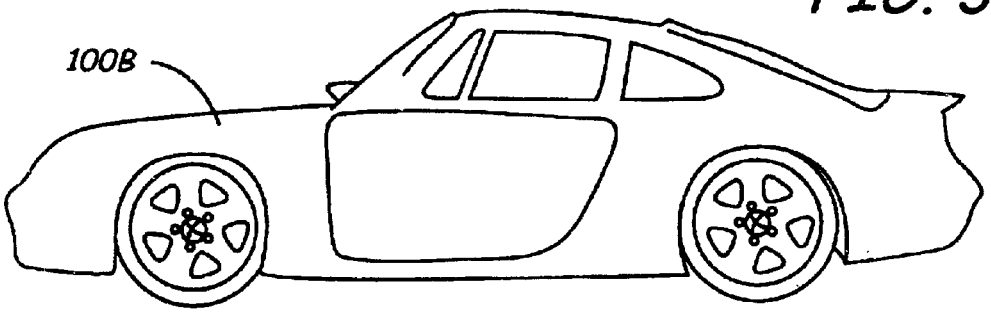
Figure 35C:
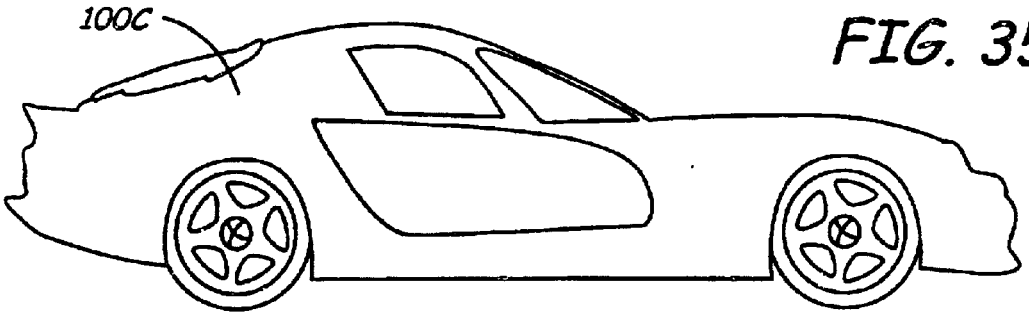
Figure 35D:
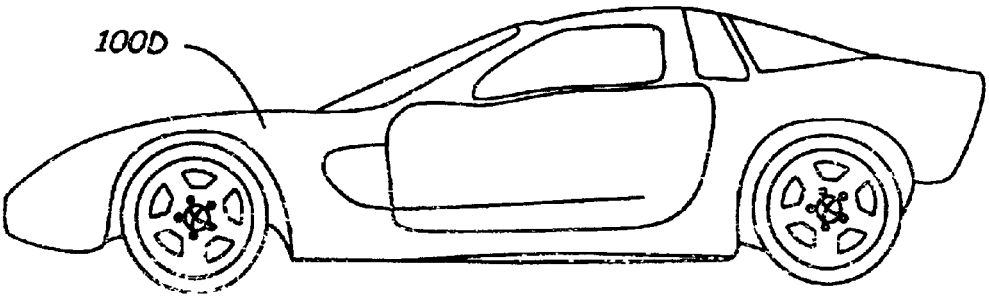
Figure 36A:
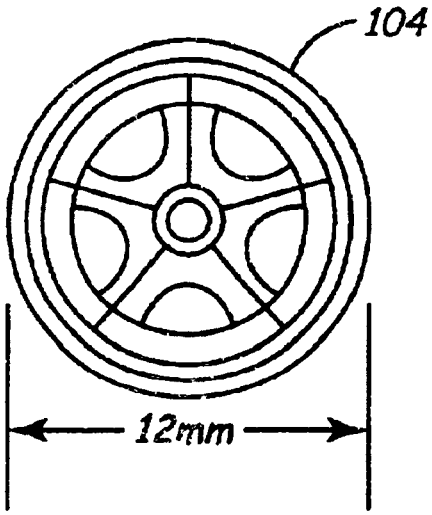
FIGS. 36*a–d* show more detailed views of the wheels that may be used with the vehicle.
Figure 36B:
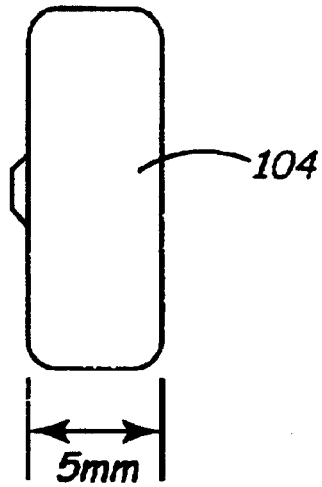
Figure 36C:
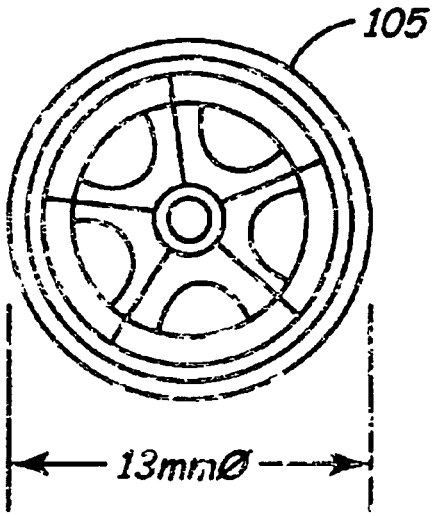
Figure 36D:
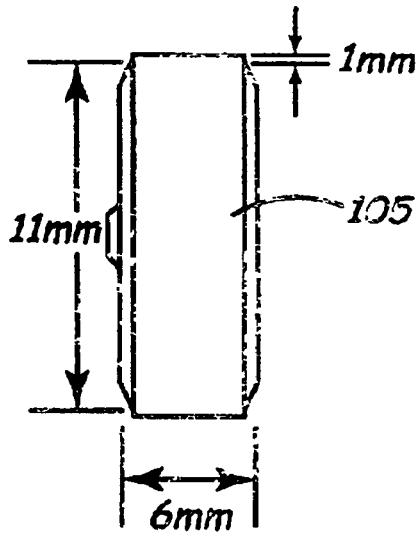

FIGS. 34*a* and 34*b* show more detailed diagrams of the start gate 401 shown in FIG. 33, in use with a vehicle 100. The vehicle 100 in the example of FIGS. 34*a* and 34*b* includes a windup motor 103. The motor 103 is pre-wound and placed in the chute 420. The motor 103 is designed such that before the vehicle 100 moves from a pre-wound state, it must be urged forward. The bellows 423 residing in the housing 424 is depressed by a user pushing downward, as shown in FIG. 34*b*. The air pressure created in the bellows 423 by the compression causes the piston 425 to move outwardly from the housing 424 exerting a force on the rear of the vehicle 100. A catch on the piston 425 prevents it from detaching from the housing 424. The force of the piston 425 causes the vehicle to move forward which in turn causes the motor 103 to start. The vehicle 100 then proceeds down the track 203.

Figure 37:
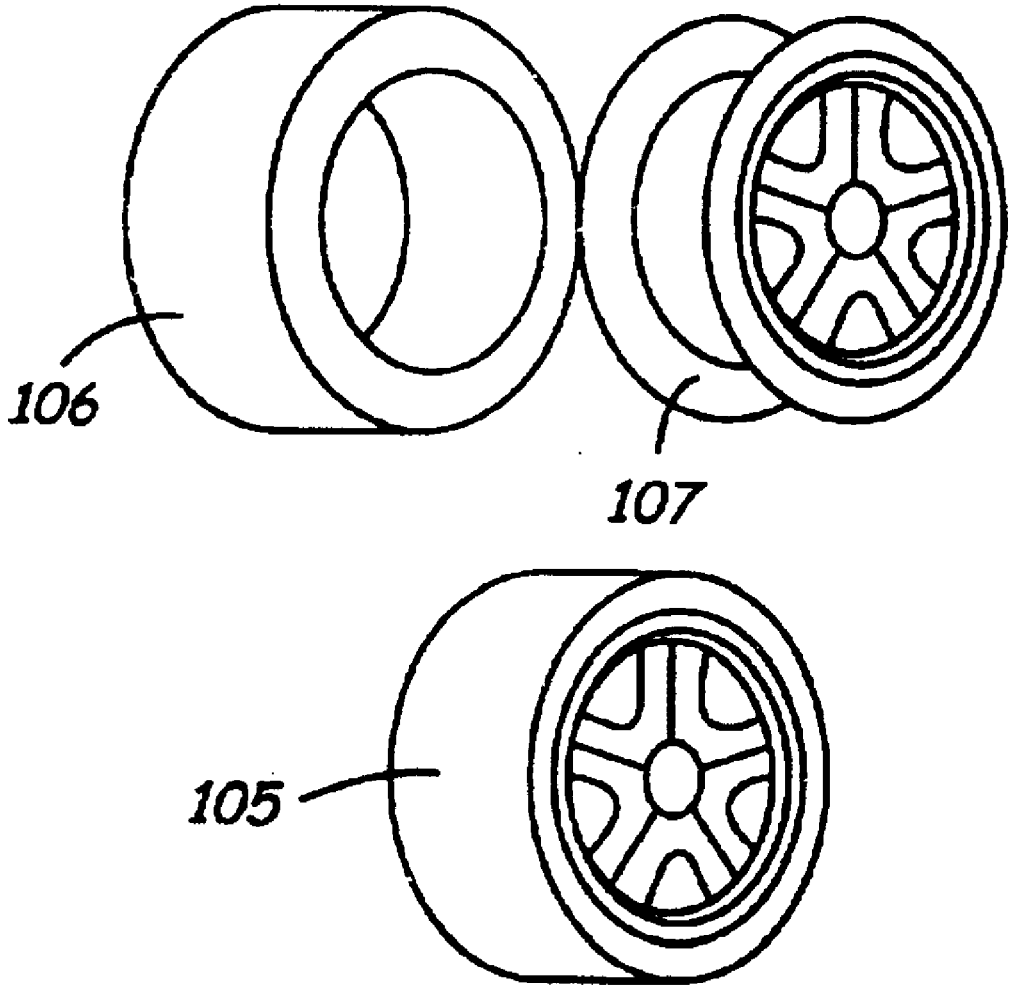
FIG. 37 shows a more detailed view of a rear wheel shown in FIGS. 36*c* and 36*d*.
Figure 38A:
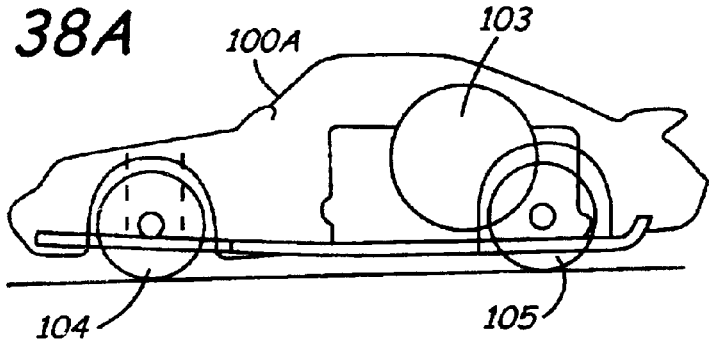
FIGS. 38*a–d* show more detailed diagrams of the connection between the body portions and the chassiss of the vehicles shown in FIGS. 35*a–d*.
Figure 38B:
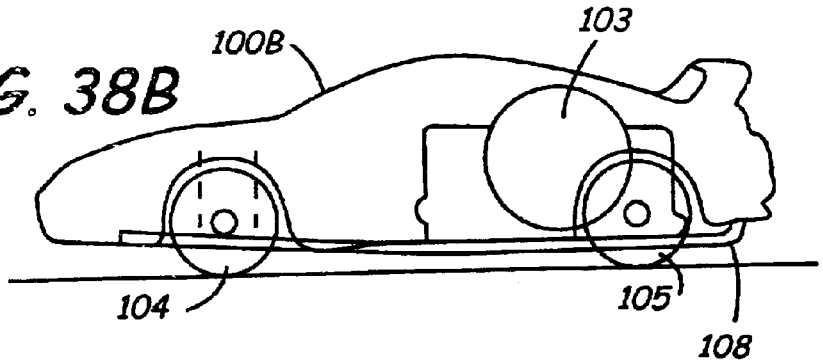
Figure 38C:
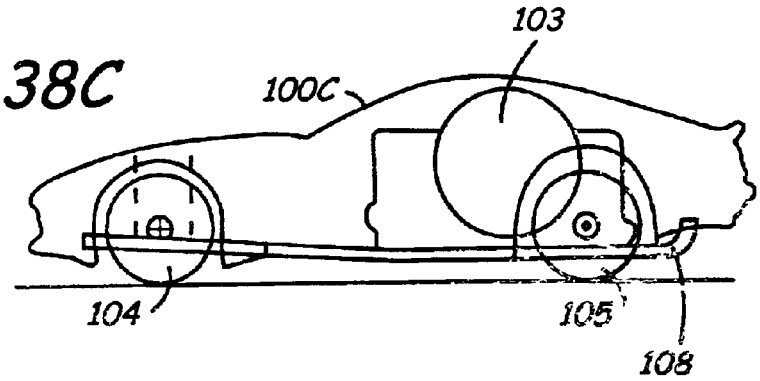
Figure 38D:
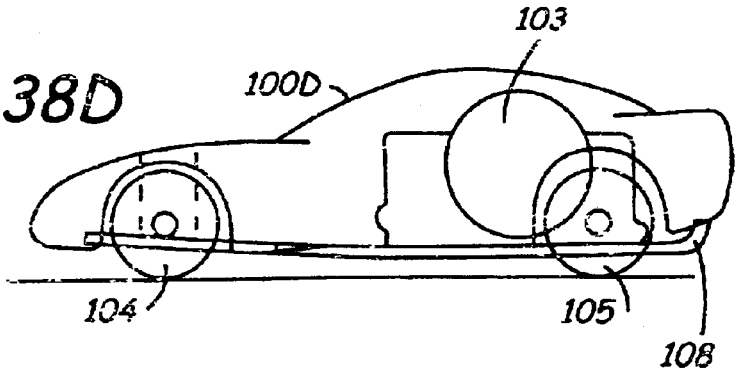

FIGS. 35*a* through 35*d* show alternative embodiments of a vehicle body portion 100*a–d*. FIGS. 36*a* through 36*d* show front and rear wheels 104, 105 that may be used by the vehicle 100 to contact the track surface. FIG. 37 shows a more detailed view of the rear wheel 105 shown in FIGS. 36*c* and 36*d*. The rear wheel 105 includes a rubber tire 106 and a rim 107. FIGS. 38*a* through 38*d* show the position of the motor 103, chassis 108, and front and rear wheels 104, 105 to the vehicle bodies 100*a–d*.

Figure 39:
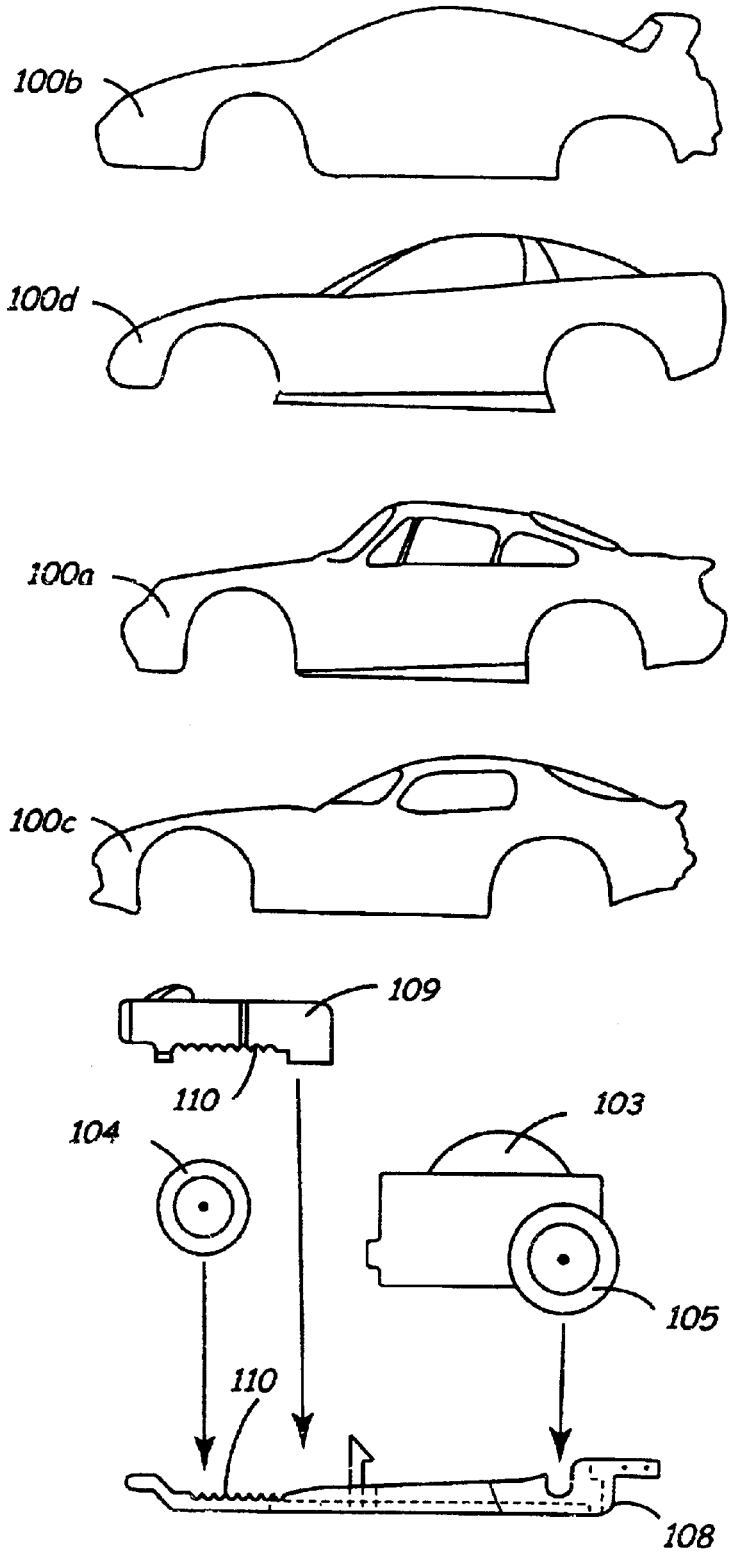
FIG. 39 shows another view of the assembly of the vehicle.

FIG. 39 shows the assembly of the vehicles shown in FIGS. 38*a* through 38*d*, including the different vehicle bodies 100*a–d* shown in FIGS. 38*a–d*. Vehicles 100 include a chassis 108 that supports the motor 103 that drives the rear wheels 105 using an axle (not shown). A protective cover 109 having relieved portions 110 is connected to the chassis 108 to hold an axle (not shown) connected to the front wheels 104. The protective cover 109 holds the axle in place using the relieved areas 110 and complementary relieved areas 110 located on the chassis 108. The relieved areas 110 allow the axle to be positioned in different locations on the chassis 108 depending upon the body style 100*a–d* that is used.

Figure 40A:
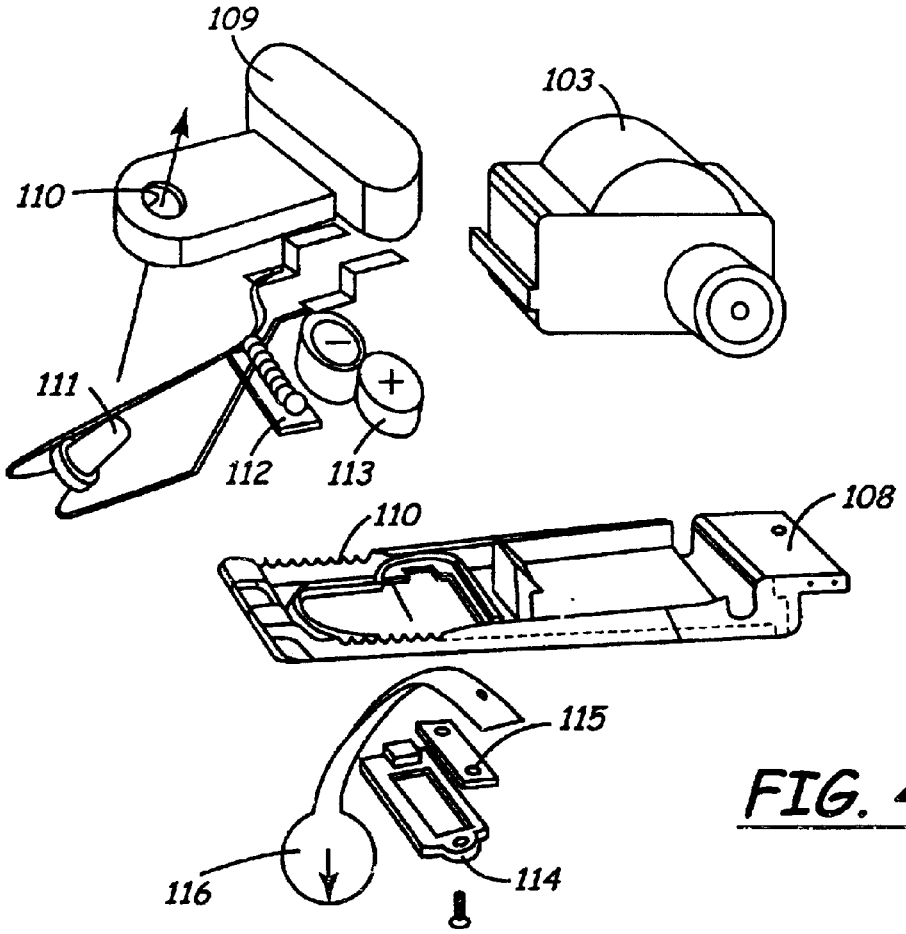
FIGS. 40*a–b* show a more detailed view of the chassis sub-assembly shown in FIG. 39.
Figure 40B:
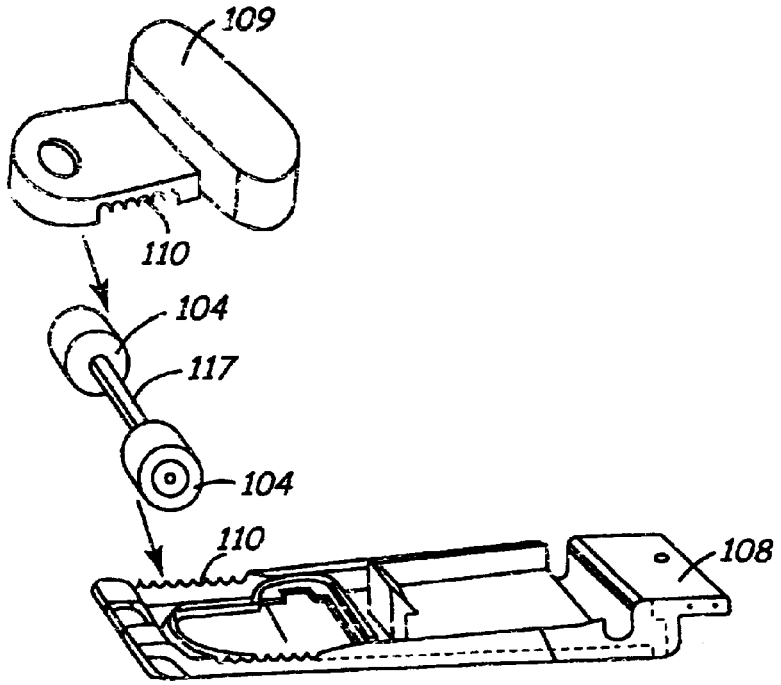

FIGS. 40*a* and 40*b* show more detailed diagrams of the components inside the vehicle 100. In the embodiment of FIG. 40*a*, the vehicle 100 also includes a light source 111, such as an LED 111. The light source 111 is powered by a power supply 113, such as a battery 113. A shake sensor 112 controls the flow of power from the power supply 113 to the light source 111. A shake sensor 112 refers to any device that senses movement of the vehicle 100, for example on a track 203. The light source 111 in the embodiment shown in FIG. 40*a* connects to the protective cover 109 through an opening 110 therein. In one embodiment, the bodies 100*a–d* of the vehicle 100 include translucent portions such as windows that allow light emitted from the light source 111 to be visible outside the vehicle 100. As the vehicle 100 moves, the shake sensor 112 detects the movement and causes the light source 111 to turn on. In one embodiment, the shake sensor 112 includes a weight that moves relative to the vehicle 100 in response to a force applied to the vehicle 100, such as a force caused by movement of the vehicle 100. In one embodiment, the shake sensor 112 triggers the light source 111 whenever the vehicle 100 is moving, while in another embodiment the shake sensor 112 is less sensitive and causes the light source 111 to emit light only when the vehicle 100 is suddenly jarred, for example during a crash. In one embodiment, the light source 111 emits a flickering light to create a strobe effect when the vehicle 100 moves on the track 203.

Also shown in FIG. 40*a*, the chassis sub-assembly includes a battery cover 114 and a contact plate 115. The vehicle 100 may also include a "try me" tab 116 that allows the user to test the battery 113 and the light 111 while the vehicle 100 is in a packaging. FIG. 40*b* illustrates the front axle 117 that connects the two front wheels 104. The front axle 117 is engaged by the relieved portions 110 in the protective cover 109 and the chassis 108. The various relieved portions 110 allow the front axle 117 to be positioned at different locations relative to the chassis 108 for different body styles 100*a–d*.

Figure 41A:
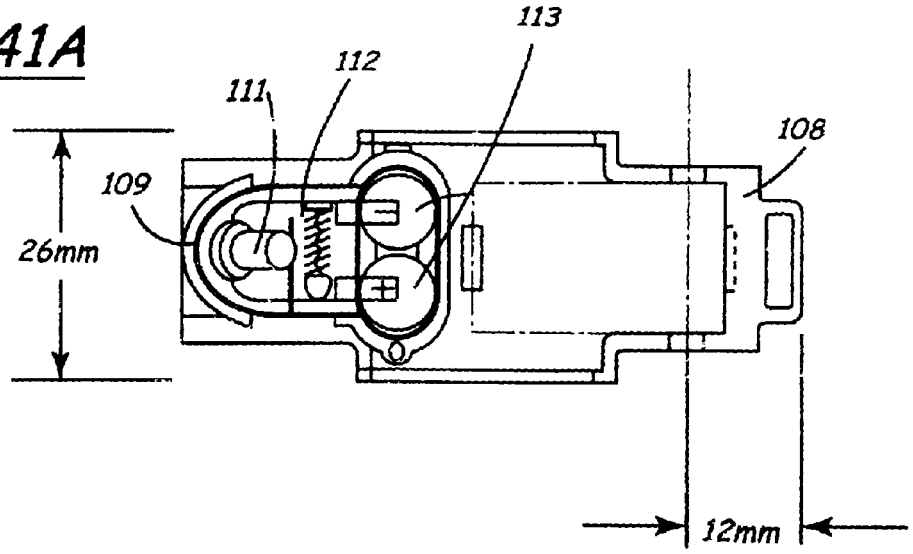
FIGS. 41*a–b* show another view of the chassis sub-assembly shown in FIGS. 40*a* and *b*.
Figure 41B:
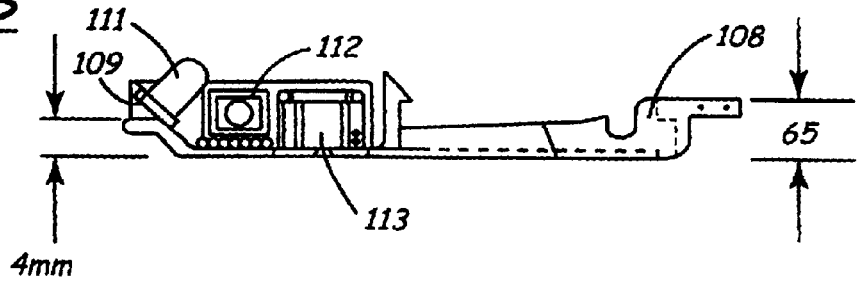
Figure 42:
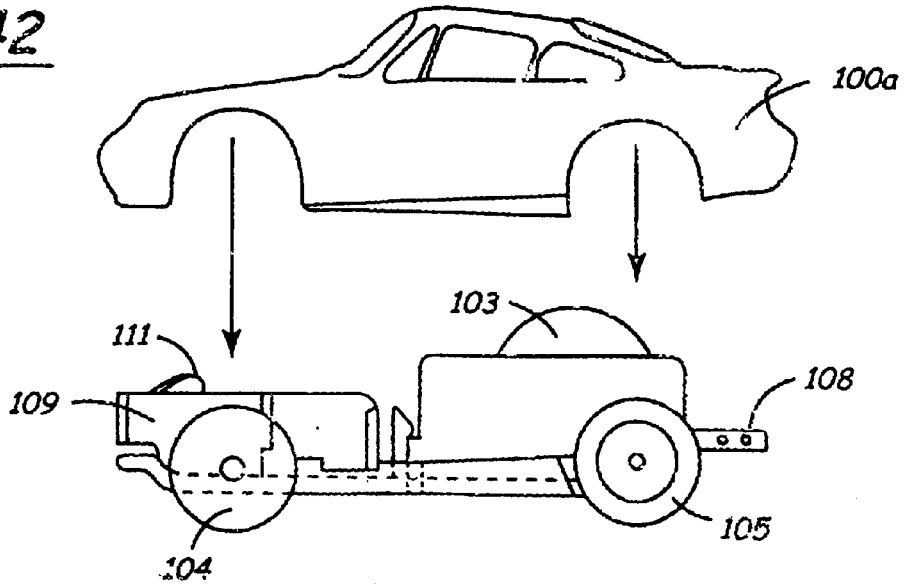
FIG. 42 shows a more detailed diagram of the connection between the body and the chassis sub-assembly of the vehicle.

FIGS. 41*a* and 41*b* show views of the chassis assembly in an assembled form. The protective cover 109 is held in place to the chassis 108, for example, by sonic welding. The protective cover 109 holds in place the light source 111, the shake sensor 112, and the power supply 113. FIG. 42 shows the assembly of one of the bodies 100*a* onto the chassis assembly including the chassis 108, the rear wheel 105 connected to the motor 103, and the front wheels 104 connected to the chassis 108 by the protective cover 109, which also holds the light source 111.

Although the present invention has been described with respect to particular embodiments thereof, variations are possible. For example, any suitable sensor for detecting the presence or a car or cars or motion thereof may be used, e.g., noise sensors, light sensors or motion sensors. The car(s) and/or track may be adapted to produce sound, e.g., by providing speakers. The car(s) and or track or portions of track may carry suitable microprocessors for controlling operations, actuation and displays. The present invention may be embodied in specific forms without departing from the essential spirit or attributes thereof. It is desired that the embodiments described herein be considered in all respects illustrative and not restrictive and that reference be made to the appended claims and their equivalents for determining the scope of the invention.

We claim:

1. A toy racetrack comprising:

a track portion having an operating surface and guide means mechanically contacting a vehicle to confine the vehicle thereon; and a jump portion having a gauge having first and second ends connected to an end of the track portion for measuring a jump of a car traveling on the track portion, wherein the car enters the first end of the gauge.

2. The toy race track of claim 1, wherein the gauge is transparent and includes indicators for measuring the jump.

3. The toy race track of claim 1, wherein the gauge has a light source connected to the second end, which light source is illuminated based on movement by the car on the race track.

4. The toy race track of claim 1, wherein the gauge has a sign comprising a plurality of adjacent parts that fall apart when the car reaches the second end of the gauge.

5. The toy race track of claim 1, further comprising a counter rest for holding the jump portion of the track in an upright position.

6. The toy race track of claim 1, further comprising a door knob latch for holding the jump portion of the track in an upright position by attaching to a door knob.

7. A toy race track system comprising:

a car having a light source located in an interior portion of the car, wherein said light source is illuminated when the car is in motion; and a track portion having an operating surface and guide means mechanically contacting the car to confine the car thereon, wherein the track portion comprises:

a jump portion having a gauge having first and second ends connected to an end of the track portion for measuring a jump of the car traveling on the track portion, wherein the car enters the first end of the gauge.

8. The toy race track system of claim 7, wherein the track portion includes an illuminated portion that is illuminated by a light source when the car is traveling on the track portion.

9. The toy race track of claim 8, wherein the track portion further includes a shake sensor that detects movement of the vehicle on the track portion and causes the light source to illuminate the illuminated portion based on the detection of the movement.

* * * * *